US009932155B2

(12) United States Patent
Hobeich

(10) Patent No.: US 9,932,155 B2
(45) Date of Patent: Apr. 3, 2018

(54) DEVICES FOR CONTROLLING FLUID OUTFLOW FROM A BOTTLE

(71) Applicant: David Hobeich, Austin, TX (US)

(72) Inventor: David Hobeich, Austin, TX (US)

( * ) Notice: Subject to any disclaimer, the term of this patent is extended or adjusted under 35 U.S.C. 154(b) by 0 days.

(21) Appl. No.: 14/144,271

(22) Filed: Dec. 30, 2013

(65) Prior Publication Data

US 2015/0182045 A1 Jul. 2, 2015

(51) Int. Cl.
*B65D 47/06* (2006.01)
*A47G 19/22* (2006.01)

(52) U.S. Cl.
CPC ..... *B65D 47/06* (2013.01); *A47G 19/2272* (2013.01); *B65D 2231/022* (2013.01); *B65D 2251/08* (2013.01); *B65D 2251/09* (2013.01)

(58) Field of Classification Search
CPC ..... A47G 19/2222; A47G 19/2272; B65D 47/06; B65D 2543/0025; B65D 2231/022; B65D 2517/0049; B65D 2251/09; B65D 2251/08
USPC ..... 220/287, 705, 709, 716, 717; 215/11.1, 215/11.4, 11.5, 45, 387–389, 305
See application file for complete search history.

(56) References Cited

U.S. PATENT DOCUMENTS

| | | | | | |
|---|---|---|---|---|---|
| 1,779,018 | A * | 10/1930 | Smallwood et al. | ..... | 206/15.3 |
| 2,070,377 | A * | 2/1937 | Simmons | ..... | 215/260 |
| 4,494,668 | A * | 1/1985 | Lottick | ..... | 220/709 |
| 4,948,009 | A * | 8/1990 | Sawatani | ..... | 220/229 |
| 5,040,703 | A * | 8/1991 | Roark | ..... | B67D 1/0406 222/173 |
| 5,381,924 | A * | 1/1995 | Kiefel | ..... | 220/709 |
| 5,937,921 | A * | 8/1999 | Guglielmini | ..... | 141/351 |
| 6,161,711 | A * | 12/2000 | Miceli et al. | ..... | 215/206 |
| 6,408,887 | B2 * | 6/2002 | Rahimzadeh et al. | ..... | 138/96 R |
| 6,427,928 | B1 * | 8/2002 | Hirota et al. | ..... | 239/33 |
| 9,050,852 | B1 * | 6/2015 | Abuzarifah | | |
| 2005/0155659 | A1 * | 7/2005 | Rahimzadeh et al. | ..... | 138/96 R |
| 2007/0090081 | A1 * | 4/2007 | Briscoe et al. | ..... | 215/307 |

* cited by examiner

*Primary Examiner* — James N Smalley
(74) *Attorney, Agent, or Firm* — Kenealy Vaidya LLP

(57) ABSTRACT

Some embodiments relate to a cap for controlling fluid flow from a bottle that includes an opening for dispensing the fluid. The cap includes a first section and a second section. The first section defines an orifice and a plurality of air channels. The opening of the bottle is in flow communication with the orifice and the plurality of air channels. The second section includes a first plurality of rings for securing the opening of the bottle, such that at least one of the air channels and the orifice creates an air-lock to secure the fluid within the bottle.

30 Claims, 13 Drawing Sheets

DEVICES FOR CONTROLLING FLUID OUTFLOW FROM A BOTTLE

TECHNICAL FIELD

The present disclosure pertains to systems and devices for covering containers. More particularly, the present disclosure pertains to systems and devices for controlling fluid outflow from bottles.

BACKGROUND

Various beverages, such as juices, carbonated drinks, water, teas, and smoothies are packaged in bottles. Some of these bottles have a relatively wide-mouth opening, while others have a relatively narrow-mouth opening, for dispensing a beverage contained therein. It may be desirable to drink the beverages directly from the bottle, without pouring the beverage into a container, especially if the container is not available, such as in the case while traveling. However, drinking directly from the bottle requires that the bottle be held with care and focus, since even slight carelessness may cause an unanticipated flow of beverage out of the bottle that may result in the beverage spilling or a user choking. Such an uncontrolled outflow of the beverage is quite common among young children, especially between ages of 1 to 7 years.

SUMMARY

One related art approach for controlling the beverage outflow from the bottle is to use a straw for drinking. Bottled beverages may be served with a straw in a variety of different settings, including social gatherings, public places, in-house get-togethers, etc. One end of the straw is submerged into the beverage, and the other end is inserted into a person's mouth for drinking. However, the straw does not effectively prevent the beverage from spilling when the bottle is jerked, dropped, or inverted due to an external stimulus, such as an accidental collision with another person, careless handling of the bottle, etc.

In fact, uncontrolled outflows can occur in a variety of situations. In one exemplary situation, multiple bottles of beverage are placed at an accessible place, such as during a birthday party. Parents usually assist young children to open-up the bottles, so that the young children can easily consume the beverage without struggling to open the bottles. Children often experience difficulty in maintaining a controlled or required flow of beverage while drinking, and are thus liable to spill the beverage on the floor, carpet, furniture, and/or other household items. In another exemplary situation, children may spill a beverage or choke when drinking the beverage directly from a bottle in a moving car due to any inadvertent jerk experienced during traveling. As indicated above, such spilling or choking may occur even when a straw is used to drink the beverage, since any sudden jerk experienced while drinking in the moving car may cause an unanticipated large quantity of beverage to gush out from the bottle around the straw. Thus, young children typically need parental assistance or supervision, and in some cases constant assistance or supervision, when drinking directly from such standard beverage bottles to impede or prevent the beverage from spilling, or impede or prevent the user from choking. As a result, parents are subjected to mental and emotional stress, particularly when they are away from their children, such as when they are at work, in a different room at home, etc.

A cover can be used to close the bottle mouth and seal the beverage within the bottle to reduce or prevent beverage spillage in various other circumstances, such as where a person wishes to store the remaining content of the bottle or delay consumption. The cover needs to be removed from the bottle mouth to enable consumption of the beverage, either directly or via a straw. Such removal and placement of the cover may be difficult for young children without parental assistance and may be inconvenient for others. Additionally, various bottles have different mouth and thread sizes, which preclude use of a single cover that fits all bottles.

It may therefore be beneficial to provide a universal bottle cover that performs at least one of the following: 1) fits bottles of different sizes, 2) controls the beverage outflow, and/or 3) reduces or prevents unintended beverage release from the bottle. Some of these embodiments provide at least one of the above operations, while at the same time facilitating ease of use. For example, some of these embodiments enable a user to drink conventionally from the bottle, via a cap, by placing the user's mouth on the cap or via a straw. The bottle cap of some of these embodiments is also configured to facilitate insertion onto the bottle, and/or removal therefrom. The bottle cap of some of these embodiments is also configured to form a resilient seal upon being properly placed on the bottle.

Various embodiments of the bottle cap are intended for use with bottles manufactured from any material and bottles of any size and shape. Some of the embodiments are disclosed in the context of dispensing a beverage directly or indirectly to a user. However, the inventive aspect is not limited to this application, and some embodiments can be applied in other contexts. In fact, some of the embodiments are intended for use with fluids other than beverages.

Some exemplary embodiments of the present disclosure include a universal bottle cap that may be used to create an air-lock that prevents or impedes the unintended flow of beverage from the cap when coupled to a bottle housing a fluid such as a beverage.

One exemplary embodiment includes a cap for controlling fluid flow from one of multiple bottles with different sized openings for dispensing the fluid. The cap includes an inner portion and an outer portion. The inner portion has a first maximum diameter and includes a first plurality of rings configured to engage a surface at a first bottle opening defining a diameter that is less than the first maximum diameter. The outer portion has a second maximum diameter and includes a second plurality of rings configured to engage a surface at a second bottle opening defining a diameter that is between the first maximum diameter and the second maximum diameter.

Another exemplary embodiment includes a cap for controlling fluid flow from a bottle that includes an opening for dispensing the fluid, the cap being configured for use with a straw. The cap includes a plurality of first rings, a plurality of second rings, and an orifice. At least one of the plurality of first rings is secured over the opening of the bottle. The orifice is defined to be in flow communication with a plurality of air channels that are surrounded by the plurality of second rings. The orifice is configured to receive the straw, such that the straw is secured by the plurality of second rings for sealing the air channels. The straw is oriented perpendicular to the at least one of the plurality of first rings.

Yet another exemplary embodiment includes a cap for controlling fluid flow from a bottle that includes an opening for dispensing the fluid. The cap includes a first portion and a second portion. The first portion defines an orifice and a plurality of air channels. The opening of the bottle is in flow communication with the orifice and the plurality of air channels. The second portion includes a plurality of first rings for securing the opening of the bottle, such that the at least one of the air channels and the orifice creates an air-lock to secure the fluid within the bottle.

Still other exemplary embodiment includes a system for controlling fluid flow from a bottle that includes an opening for dispensing the fluid. The system includes a cap and a straw. The cap includes a plurality of first rings, a plurality of second rings, and an orifice. At least one of the plurality of first rings is secured over the opening of the bottle. The orifice is defined to be in flow communication with a plurality of air channels that are surrounded by the plurality of second rings. The straw is configured to be received by the orifice, and to be secured by the plurality of second rings for sealing the air channels, such that the straw can be oriented perpendicular to the at least one of the plurality of first rings.

Additional objects and advantages of the present disclosure will be set forth in part in the description which follows, and in part will be understood from the description, or may be learned by practice of the claimed invention. The objects and advantages of the claimed invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

FIGS. 11A-11B are top and bottom schematic views of the exemplary cap of FIG. 10, respectively, according to an embodiment of the present disclosure;

FIGS. 11C-11D are first and second perspective views of the exemplary cap of FIG. 10, respectively, according to an embodiment of the present disclosure;

FIG. 12 is a schematic showing interior and exterior portions of the cap of FIG. 10, according to an embodiment of a present disclosure;

FIGS. 14A-17B are schematics that illustrate exemplary scenarios for using the cap of FIG. 10, according to an embodiment of the present disclosure.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

As used in this specification and the appended claims, the singular indefinite articles "a," "an," and the definite article "the," should be considered to include or otherwise cover both single and plural referents, unless the content clearly dictates otherwise. In other words, these articles are applicable to one or more referents. As used in this specification and the appended claims, the term "or" should be considered to mean "and/or," unless the content clearly dictates otherwise.

References in the specification to "an embodiment," "some embodiments," "other embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, if a particular feature, structure, or characteristic is described in connection with an embodiment, then it would be within the knowledge of one skilled in the art to affect such feature, structure, or characteristic in connection with, other embodiments, whether or not explicitly described, unless cleared stated to the contrary.

Exemplary Embodiments

Figure 1:
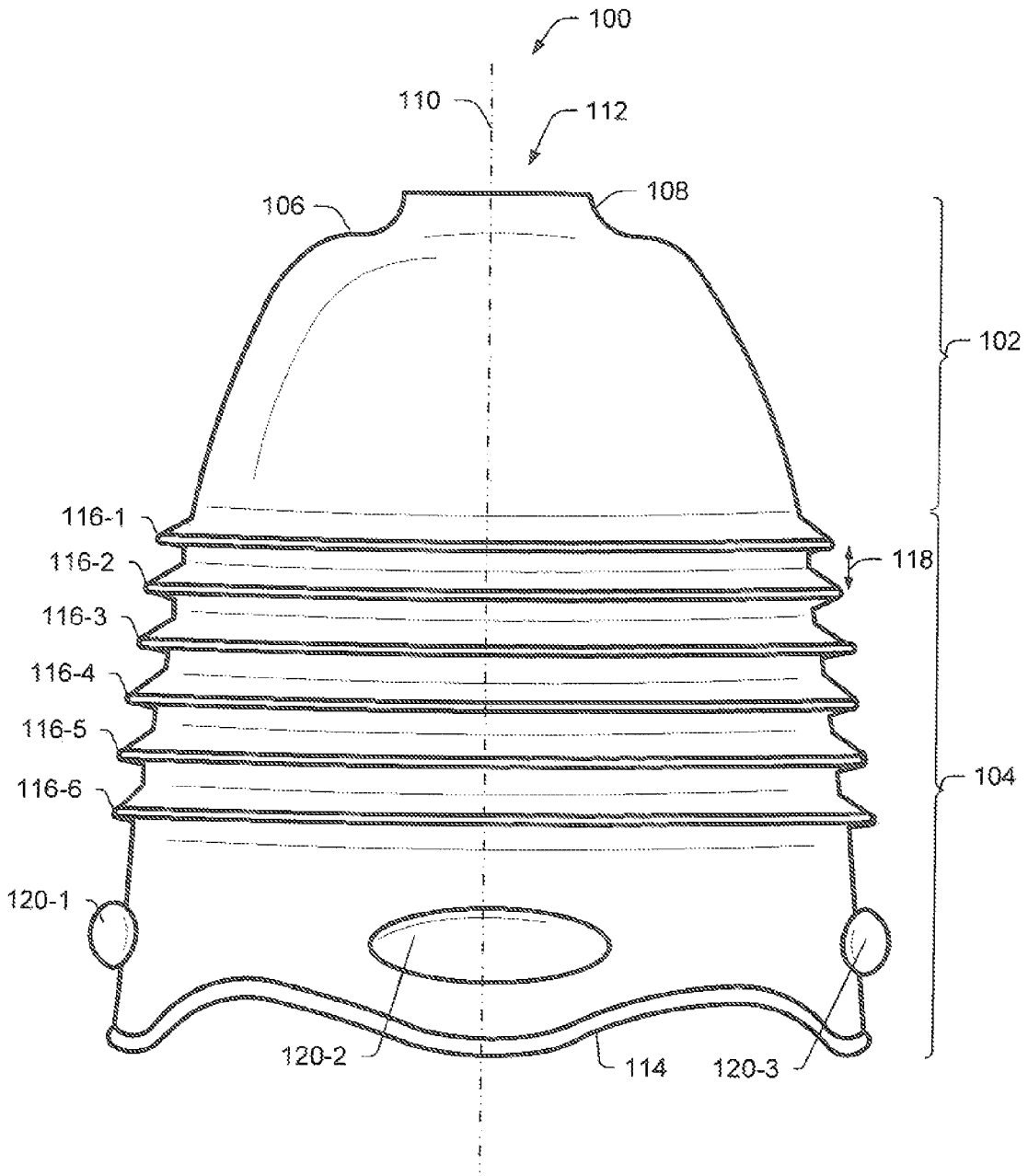
FIG. 1 is a schematic of a cap for controlling beverage outflow from a bottle, according to a first exemplary embodiment of the present disclosure.
Figure 2A:
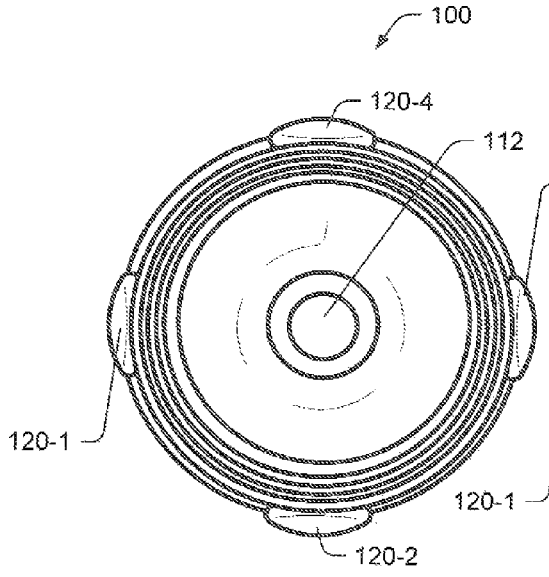
FIGS. 2A-2B are top and bottom schematic views of the exemplary cap of FIG. 1, respectively, according to an embodiment of the present disclosure.

FIG. 1 is a schematic that illustrates an exemplary cap 100 for controlling the flow of a fluid, such as a beverage, from a bottle. The cap 100 includes a hollow body having a first section 102 and a second section 104. The first section 102 includes a circular head 106 having a cylindrical projection 108, which may be concentric about a vertical central axis 110 of the cap 100. The cylindrical projection 108 includes an orifice 112 (FIG. 2A) and assists in longitudinally receiving an elongate tube, for example, a straw. The cylindrical projection 108 guides a fluid, such as a beverage, that flows out through the orifice 112. The diameter of the orifice 112 may be relatively smaller than that of the circular head 106. In some embodiments, the orifice 112 may be covered with a flexible material, such as silicone, having one or more slots or incisions. In some embodiments, the slots or incisions may maintain a closed surface to impede liquid from passing therethrough, but may open-up when the material is squeezed or when the fluid pressure inside the bottle is increased. Thus, when the squeezing force or the fluid pressure is decreased, the slots or incisions may close to impede or prevent the fluid within the bottle from flowing out through the orifice 112.

Figure 2B:
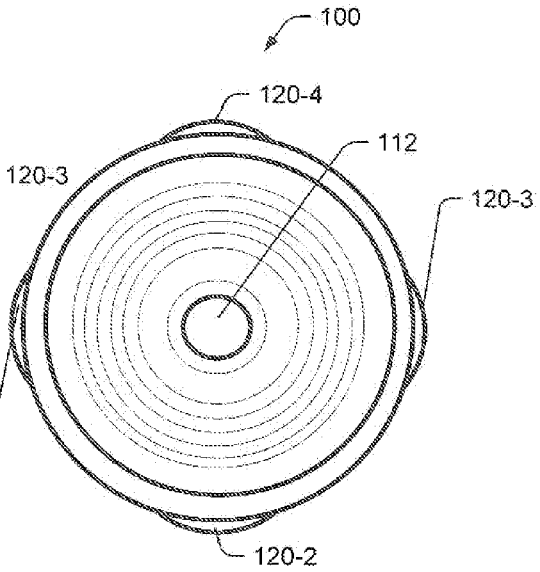
Figure 2C:
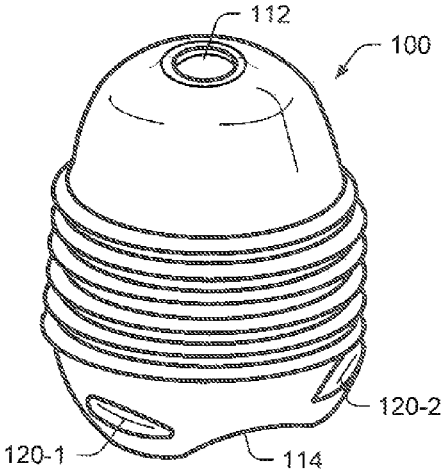
FIGS. 2C-2D are first and second perspective views of the exemplary cap of FIG. 1, respectively, according to an embodiment of the present disclosure.

The head 106 radially curves and extends to the second section 104, such that the first section 102 acquires a dome-like shape (FIG. 2C). The first section 102 and the second section 104 have a circular cross-section, increasing in diameter from the circular head 106 to a bottom edge 114 of the second section 104, such that the cap 100 acquires a slightly conical shape. In an embodiment, the smallest diameter of a cross-section of the first section 102 may be of a suitable dimension adapted for being sufficiently received within the mouth of an intended user. However, the shapes of the above elements are merely provided for exemplary purposes, and these elements can be formed of any other shape that enables them to perform their various operations.

The second section 104 includes multiple external rings 116-1, 116-2, 116-3, 116-4, 116-5, and 116-6 (collectively, external rings 116), each extending radially outward from an outer surface of the second section 104. The number of external rings 116 that may be accommodated on the outer surface may vary depending on a vertical length of the second section 104. Increasing the number of external rings 116 increases the friction between a surface of the second section 104 (including the external rings 116) and any extraneous surface in contact therewith. The diameters of the external rings 116 increase from an upper-most external ring, such as the external ring 116-1, to a bottom-most external ring, such as the external ring 116-6, along the outer surface of the second section 104. In some embodiments, the upper-most ring is a ring closest to the first section 102, and the bottom-most ring is a ring closest to the bottom edge 114 of the second section 104. Each of the external rings 116 is separated from an adjacent external ring by a predetermined spacing, for example, a spacing 118. In some embodiments, such predetermined spacing can be determined based on the intended friction to be induced between the second section 104 and any extraneous surface placed in communication with the external surface. Reducing the spacing, such as the spacing 118, between two adjacent external rings 116, increases the friction applied by the external rings 116 between the second section 104 and the extraneous surface. In some embodiments, external rings, such as the external rings 116, may be additionally located on an outer surface of the first section 102. The external rings 116 also facilitate to apply a suitable frictional force on the cap 100 when the cap 100 is pushed sideways for removal from an extraneous surface such as a bottle opening.

The second section 104 may further include one or more grips between the bottom-most external ring, such as the external ring 116-6, and the bottom edge 114 of the second section 104. For example, as shown in FIG. 2B, the second section 104 may include grips 120-1, 120-2, 120-3, and 120-4 (collectively, grips 120), each located in a quadrant associated with a circular cross-section between the bottom-most external ring 116-6 and the bottom edge 114 of the second section 104. The grips 120 may be projections of a variety of shapes and dimensions that extend outward from the outer surface of the second section 104. As shown, the grips 120 may be oval in shape, although other suitable shapes, such as rectangular, triangular, trapezoidal, or irregular may be contemplated. In fact, embodiments are intended to include the grips 120 or any structure that facilitates removal of the cap 100 from the extraneous surface when the cap 100 is inverted and in communication with the extraneous surface. In some embodiments, any number of grips 120 may be placed at any location on the second section 104, for example, proximate to or on the bottom edge 114, to facilitate removal of the cap 100 as discussed above, and/or provide any other useful functionality.

Figure 2D:
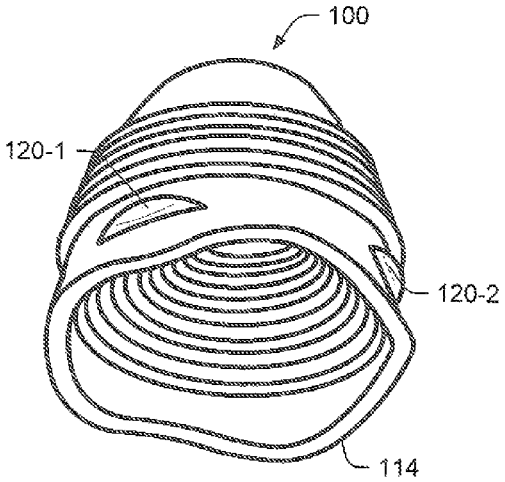

Further, the bottom edge 114 may have a curved contour to ease the placement of the cap 100 over a bottle (not shown). For example, the second section 104 may have a flared bottom edge 114. Also, as shown in FIG. 2D, the second section 104 has an inner surface including internal rings, which are discussed below in greater detail. The inner surface surrounding the bottom edge 114 may be shaped at a suitable angle or slope that enables the bottle edge 114, and in turn the cap 100, to easily slide over any contour on the bottle surface. For example, the inner surface may gradually increase in thickness in a direction away from the bottom edge 114 to the orifice 112, such that the surrounding inner surface defines a shape that is similar to an angular outer surface of an imaginary cone. Each of the head 106, the first section 102, and the second section 104 may have the same or different cross-sections depending on a cross-section of the bottle opening through which a beverage contained in the bottle may be dispensed.

The cap 100 may be made using a variety of food-grade polymers that are flexible in nature. For example, the cap 100 may be made of 100% food-grade silicon that is free from Bisphenol A (BPA) and other health hazardous materials. Other suitable polymers, such as Hytrel TPC-ET; Delrin POM; Zytel HTN high-performance polyamide; Crastin PBT; Zytel 6, 6/6 and 6/12 nylon (polyamide); Rynite PET; and Sorona EP PTT may also be used for fabricating the cap 100. The polymer should be suitably flexible to enable the cap 100 to stretch when manipulated (such as when placing it over the bottle opening), and regain its original shape after such manipulation, such as when the cap 100 is removed from the bottle opening. However, embodiments are intended to include bottle caps, such as the cap 100, made of any known, related art, or later developed materials.

In some embodiments, the second section 104 of the cap 100 may include a predetermined portion capable of being folded outward when manipulated. For example, the predetermined portion may be a bottom portion of the second section 104 including the bottom edge 114 that may be manipulated to a folded configuration. In the folded configuration, the bottom edge 114 may be folded radially outward until the bottom portion is folded inside-out such that an inner surface of the bottom portion is exposed to the external environment. The folded bottom portion includes an outward bend (not shown) about which the bottom portion extends upward towards the first section 102.

Once the predetermined portion is folded substantially outward, it may be maintained in the folded configuration using a variety of techniques. In one example, an inner surface of the predetermined portion may include one or more physical structures that facilitate to maintain the predetermined portion in the folded configuration. Examples of these physical structures include, but not limited to, grooves, indentations, projections, and so on. In another example, the predetermined portion may have a suitable folded length that maintains the predetermined portion in the folded configuration. The folded length is sufficiently long that resists a retracting force induced in an outward bend created in the predetermined portion. In some embodiments, the outward bend may secure an extraneous surface, such as a narrow edge of a bottle opening, between an outer surface of the predetermined portion and the outer surface of the second section 104, when the cap 100 is inverted. The folded predetermined portion may be straightened about the outward bend until the cap 100 regains its original conical shape, such as when the cap 100 is to be removed from the bottle opening.

Figure 3:
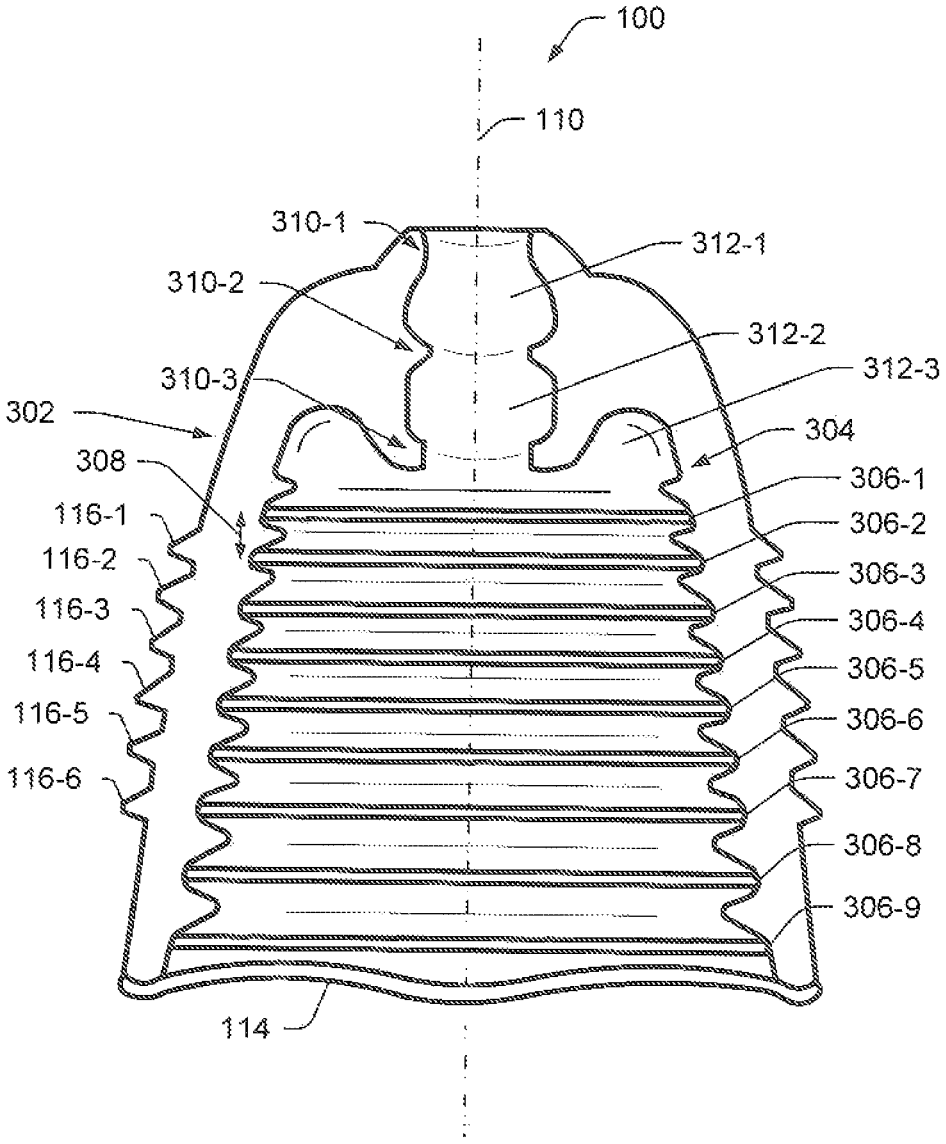
FIG. 3 is a schematic showing interior and exterior portions of the cap of FIG. 1, according to an embodiment of a present disclosure.

FIG. 3 is a schematic showing interior and exterior portions of the cap 100 of FIG. 1. The cap 100 has an exterior portion 302 including the external rings 116 on the outer surface of the second portion, as discussed above. The cap 100 has an interior portion 304 including an inner surface having a number of internal rings 306-1, 306-2, . . . , 306-9 (collectively, internal rings 306). Increasing the number of internal rings 306 increases the friction between the inner surfaces of the second section 104 or the first section 102 (including the internal rings 306) and any extraneous surface placed in communication with such inner surface. The internal rings 306 may be disposed partially on an inner surface of the first section 102, and located substantially on the inner surface of the second section 104. The diameters of the internal rings 306 increase from an uppermost internal ring, such as the internal ring 306-1, to a bottom-most internal ring, such as the internal ring 306-9, along the inner surfaces of the first section 102 and the second section 104.

Similar to the external rings 116, each of the internal rings 306 is separated from an adjacent internal ring by a predetermined spacing, such as a spacing 308. In some embodiments, the predetermined spacing may be based on the intended friction to be caused between the inner surfaces of the first and the second portions 102, 104, and any extraneous surface placed in communication with these inner surfaces. The internal rings 306 and the external rings 116 are substantially perpendicular to the vertical central axis 110 of the cap 100 and parallel to or otherwise communicate with each other to strongly hold, grip and seal the cap 100 against the extraneous surface, such as an outer surface of a bottle.

In some embodiments, each of the internal rings 306 may be coupled to each other in a spiral fashion so that the internal rings 306 may be screwed on to any extraneous surface, such as a bottle opening. Similarly, the external rings 116 may be coupled to each other in a spiral fashion so that the external rings 116 may be screwed to any extraneous surface, such as a bottle opening when the cap 100 is inverted. The internal and external rings can be provided in other relative dispositions or orientations. However, regardless of whether they are provided in parallel, form a spiral, or some other relative disposition or orientation, the internal rings 306 and the external rings 116 impede or prevent leakage of a beverage stored within the bottle, and impede or prevent the cap 100 from falling off or being inappropriately removed, such as by young children.

The interior portion 304 of the first section 102 of the cap 100 may further include a drainage system including a number of drainage rings 310-1, 310-2, and 310-3 (collectively, drainage rings 310) and air channels 312-1, 312-2, and 312-3 (collectively, air channels 312). The drainage rings 310 may be located along the inner surface of the first section 102. Each of the drainage rings 310 extends between the cylindrical projection 108 and the upper-most internal ring such as the internal ring 306-1. At least two of the drainage rings 310 are sufficiently flexible to secure an elongate tube, such as a straw, received through the orifice 112 on the first section 102. The drainage rings 310, the internal rings 306, and the external rings 116 may have relatively the same flexibility or have different flexibilities.

The drainage rings 310 are disposed around the air channels 312 located along the inner surface of the first section 102. In some embodiments, each of the drainage rings 310 may be relatively the same size or have different sizes. For example, the sizes may be based on the dimensions of the surrounding air channels 312, and the dimensions of an elongate tube, such as a straw, that may be received and secured by the drainage rings 310. At least one of the air channels, such as the air channel 312-3, is relatively larger than the other air channels 312-1 and 312-2. The air-channel 312-3 provides a relatively larger space to accommodate a fluid while the fluid flows through the interior portion 304 of the cap 100, thereby reducing the pressure of the fluid flowing out from the orifice 112. In other words, the fluid pressure is reduced by virtue of the additional space provided by the air-channel 312-3. The air channel 312-3 is shown in the figures as being dome-shaped, but can be formed in other shapes, and is in communication with the upper-most internal ring, such as the ring 306-1. In fact, embodiments are intended to include any form or shape of air channel 312-3 or any other structure that disperses the beverage pressure away from the drainage ring 310-3, while also enabling the drainage ring 310-3 to close relatively tighter against a straw due to the beverage pressure created within the inverted bottle.

Further, the orifice 112 is in flow communication with the second section 104 via the drainage rings 310 and the air channels 312 located in the first section 102. The drainage rings 310 and the air channels 312 together control the beverage outflow from the orifice 112. The air in the air channels 312 creates high pressure relative to the pressure at which the beverage is secured within the bottle adjacent to the orifice 112, thereby impeding or preventing the beverage outflow from the orifice 112, discussed below in greater detail. The air channels 312 and the orifice 112 may have suitable dimensions based on the intended pressure to be created by the air-lock. Reducing the size of air channels 312 and that of the orifice 112 increases the pressure exerted by the associated air-lock.

Figure 4A:
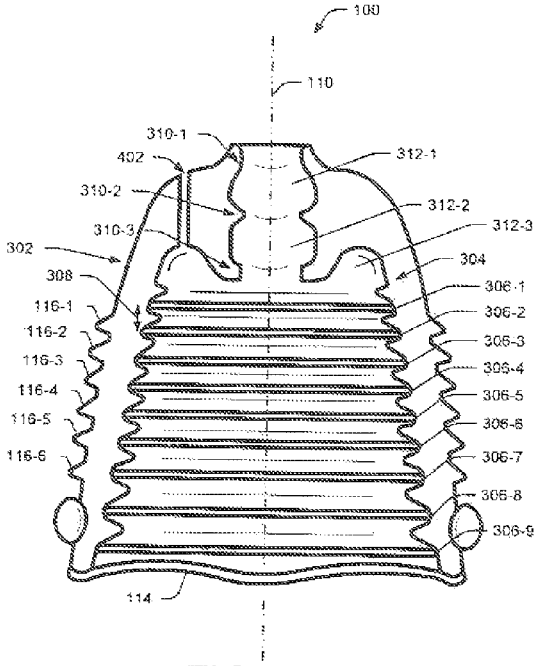
FIGS. 4A-4B are schematics showing a hole in communication with an air channel of the cap of FIG. 1, according to an embodiment of a present disclosure.
Figure 4B:
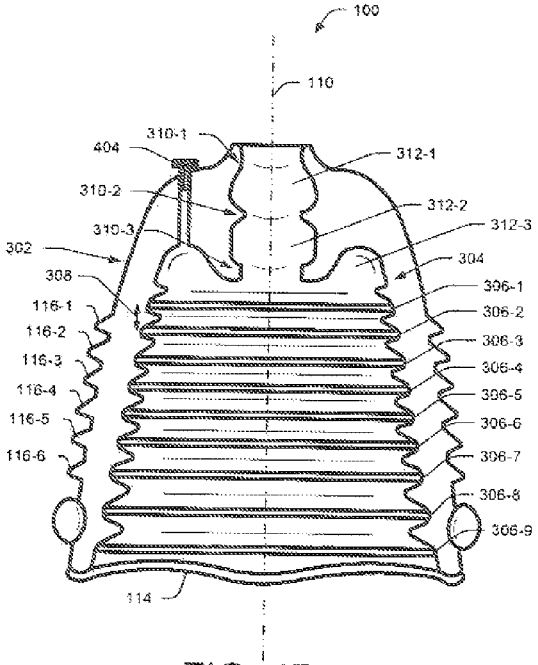

In some embodiments, such as those shown in FIG. 4A, the first section 102 may include one or more holes or channels, such as a hole 402 on the exterior portion 302 of the cap 100. The hole 402 may extend into the first section 102 to communicate with the air channel 312-3 that is relatively larger than the other air channels 312-1, 312-2. This hole 402 may release air pressure within the air channel 312-3 for allowing a fluid, such as a beverage, to easily flow out from the orifice 112 during drinking, either directly from the orifice 112 or via a straw. The hole 402 may have a suitable dimension based on the intended pressure to be applied on the beverage within the bottle. For example, increasing the diameter of the hole 402 reduces the air pressure in the air channel 312-3, thereby increasing the fluid flow out from the orifice 112. The hole 402 may be closed using a cork 404 (FIG. 4B) or any other suitable known, related art or later developed closure tool for impeding or preventing or reducing the fluid flow from the orifice 112 and sufficiently securing the fluid within the bottle.

Figure 5:
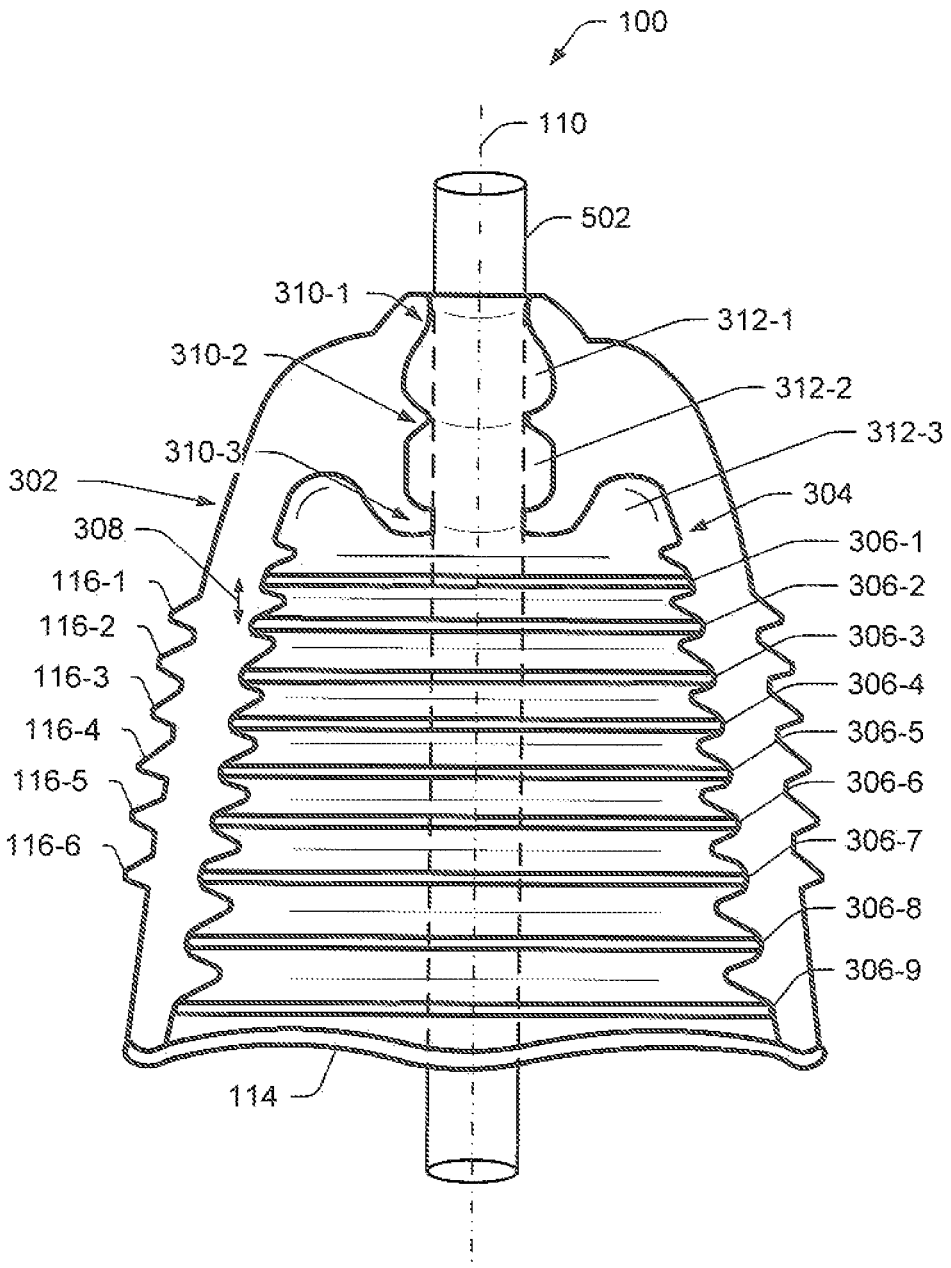
FIG. 5 is a schematic showing the interior and exterior portions of the cap of FIG. 1 including a straw, according to an embodiment of a present disclosure.

FIG. 5 is a schematic showing the interior and exterior portions of the cap 100 of FIG. 1, including a straw 502 that may be received through the orifice 112 on the first section 102. The straw 502 may be secured by the drainage rings 310 along the vertical central axis 110 of the cap 100. The drainage system, including the drainage rings 310 and the air channels 312, may be adapted to have a suitable width, height, or thickness for at least partially receiving different sizes of straws. When the straw 502 is extended perpendicular to the internal rings 306, the air channels 312 are sealed by an outer surface of the straw 502. The sealed air channels 312 have air trapped at high pressure that obstructs a passage extending between the upper-most internal ring 306-1 and the orifice 112 along the outer surface of the straw 502. In addition to the sealed air channels 312, the straw 502 creates an air-lock by holding the air within the straw, i.e., straw air, at a pressure that is greater than the beverage pressure to impede or prevent the beverage outflow through the straw 502, which is discussed in greater detail below.

Figure 6A:
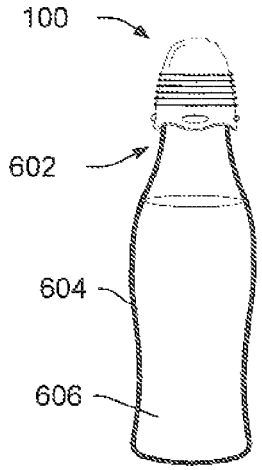
FIGS. 6A-9B are schematics that illustrate exemplary scenarios for using the cap of FIG. 1, according to an embodiment of the present disclosure.

FIGS. 6A-9B are schematics that illustrate exemplary scenarios for using the cap 100 of FIG. 1, according to an embodiment of the present disclosure. FIGS. 6A-6B illustrate a first exemplary scenario for using the cap 100 of FIG. 1. As shown in FIG. 6A, the cap 100 may be disposed over a narrow portion 602 of a bottle 604 that houses a beverage 606. The narrow portion 602 may include an opening or bottle opening (not shown) that may be used for dispensing the beverage 606. The cap 100 may be gently pushed down on to or screwed to the bottle opening by holding the first section 102 from the top or sideways. The cap 100 may be manipulated until it secures the bottle opening in an air-tight manner using the internal rings 306 that frictionally engage with the bottle opening or the narrow portion 602 of the bottle 604, or both. In some embodiments, the cap 100 may be gently pressed down until the bottle opening is coaxial with the upper-most internal ring of the cap 100 for securing the bottle opening. In some other embodiments, the narrow portion 602 of the bottle 604 or the bottle opening optionally include one or more outer rings (not shown) that frictionally engage with the internal rings 306. The internal rings 306 may click down on top of the outer rings for securing the bottle opening within the cap 100. The diameters of each of the internal rings 306 conform to the same or changing diameters of the narrow portion 602 of the bottle 604, such that the diameter of the upper-most internal ring, such as the internal ring 306-1 may be substantially equivalent to the diameter of the bottle opening.

The orifice 112 of the cap 100 is in fluid communication with the bottle opening via the drainage rings 310 and the air channels 312. The air in the air channels 312 creates an air-lock that impedes or prevents the beverage 606 to flow out from the orifice 112. Moreover, the dome-shape of the air channel 312-3 spreads and reduces the beverage pressure away from the drainage ring 310-3 to impede the beverage flow to the orifice 112. The air-lock secures or helps to substantially secure the beverage 606 inside the bottle 604 without spilling even when the bottle 604 is jerked, dropped or inverted.

Figure 6B:
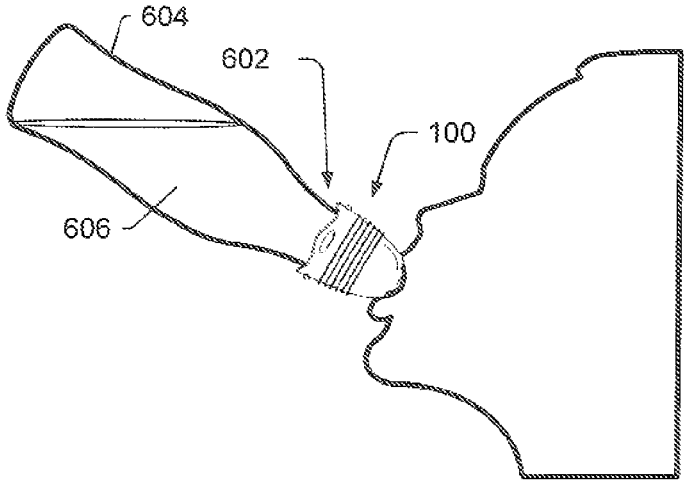

As shown in FIG. 6B, a person may intend to drink the beverage 606 directly from the bottle 604 on which the cap 100 is disposed. The first section 102 of the cap 100 may be received into the person's mouth to hygienically consume the beverage 606. The bottle 604 may be held in a tilted orientation to slide the beverage 606 toward the orifice 112 of the cap 100 via the bottle opening. The bottle cap 100 is intended to be used with bottles made of a variety of known, related art or later developed materials that are relatively flexible. For example, the bottle 604 may be made of plastic or any other suitable flexible material that may be pressed or squeezed to variably apply pressure on the beverage 606. Once the applied pressure increases beyond the air-lock pressure, the beverage 606 pushes out the air in the air channels 312 to outflow from the orifice 112. As the beverage 606 flows out and the pressure on the bottle 604 is released, the air channels 312 are again filled-up by air that offers resistance to the beverage flow and reduces the speed of the beverage 606 flowing out from the orifice 112. Ceasing further squeezing of the bottle 604 reduces the pressure applied on the beverage 606 below the air-lock pressure created by the air channels 312 and the orifice 112 of suitable sizes, thereby impeding or preventing the release of the beverage 606 from the orifice 112 of the cap 100. Such a controlled release of the beverage 606 due to the air-lock created by the air channels 312 and the orifice 112, as well as the applied pressure on the beverage 606 impedes or prevents spilling or leaking of the beverage 606 if the bottle 604 is jerked, dropped, inverted, etc.

Once the beverage 606 is consumed, or if otherwise intended, the cap 100 may be removed from the bottle opening by pulling out or by pushing at least one of the first section 102 and the second section 104 outwards or sideways. The removed cap 100 may be rinsed or washed and re-used with another bottle 604 for controlling the beverage outflow. However, other embodiments are directed to disposable bottle caps, such as the bottle cap 100.

Figure 7A:
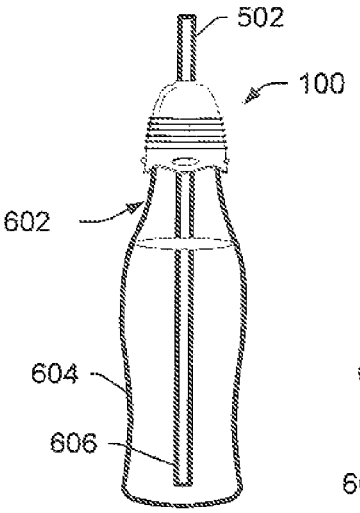
Figure 7B:
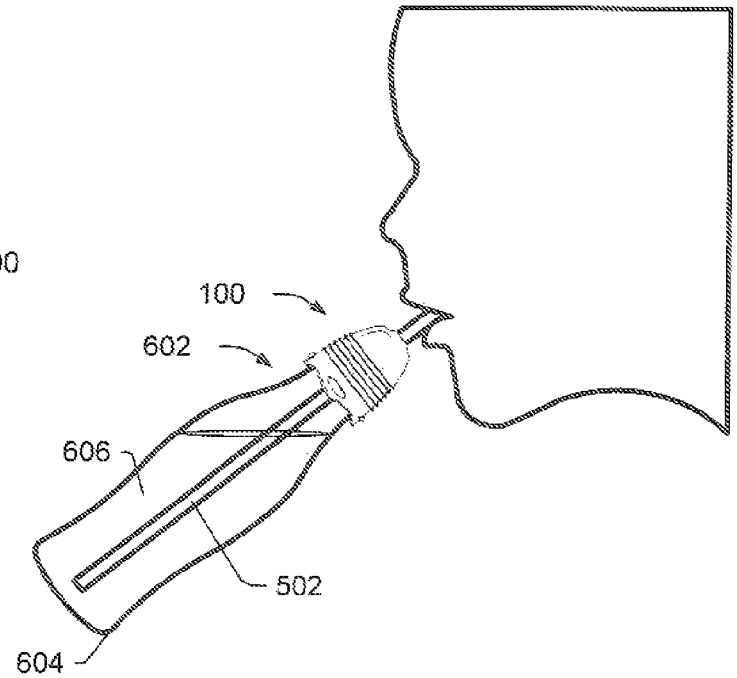

FIGS. 7A-7B illustrate a second scenario for using the exemplary cap 100 of FIG. 1. As shown in FIG. 7A, the cap 100 may be secured over the bottle opening (not shown) in an air-tight manner using the internal rings 306, such that the orifice 112 is in fluid communication with the bottle opening via the air channels 312 as described in the description of FIG. 6A. In some embodiments, an elongated tube, such as the straw 502, may be received by the orifice 112 and extended into the bottle 604 via the drainage rings 310 and the air channels 312 in the cap 100. The straw 502 may have a first end submerged into the beverage 606 in the bottle 604 and a second end extending out through the orifice 112. When used with a straw 502, the cap 100 is intended to be used with bottles made of a variety of known, related art or later developed materials. For example, the bottle 604 may be made of plastic, glass, silicone, aluminum or any other suitable food-grade material.

The straw 502 is secured within the cap 100 using the drainage rings 310. The straw 502 may be held perpendicular to the internal rings 306, such that the straw 502 substantially seals the air channels 312 between the outer surface of the straw 502 and the inner surface of the cap 100. The trapped air in the sealed air channels 312 creates an air-lock that impedes or prevents the beverage 606 to outflow or leak along the outer surface of the straw 502. Additionally, the straw air, exerts a uniform or substantially uniform pressure on the beverage 606 along the inner walls of the straw 502 in accordance with the Pascal's law, which may be mathematically represented in Equation 1.

$$\Delta P = \rho g(\Delta h) \tag{1}$$

In Equation 1, ΔP represents hydrostatic pressure (given in pascals), or the difference in pressure at two points within a fluid column, i.e., a cylindrical hollow region of the straw 502, due to the weight of the fluid, i.e., air. ρ refers to air density (in kilograms per cubic meter) in the fluid column. g is the acceleration due to gravity (in meters per second square). Δh refers to a height of fluid, i.e., air, above the point of measurement on the surface of the beverage 606, or the difference in elevation between a point on a beverage surface and another point adjacent to the second end of the straw 502 within the fluid column (in meters). Based on Equation 1, the straw 502 may have predetermined diameter and height that creates a suitable air-lock within the straw 502. Reducing the diameter and height increases an effective pressure of straw air relative to a pressure of the beverage within the bottle to create the air-lock.

An exerted pressure on the beverage 606 by the straw air creates a secondary air-lock, which along with a primary air-lock created by the sealed air channels 312, impedes or prevents any unintended release of the beverage 606 from the orifice 112 through the bottle opening. Therefore, the beverage 606 is secured or substantially secured within the bottle 604 without spilling if the bottle 604 is jerked, dropped, or inverted, etc.

As shown in FIG. 7B, a user may consume the beverage 606 by receiving the second end of the straw 502 into the user's mouth. In order to release the beverage 606 so that it can flow out from the second end of the straw 502, the primary air-lock may be removed by angling the straw 502 using the flexibility of the drainage rings 310 and the air channels 312. The straw 502 may be forced to tilt at any suitable angle, except 90 degrees with respect to the internal rings 306. The angled straw 502 opens-up the air channels 312 to release the trapped air, and in turn eases the pressure on the beverage 606 for assisting the beverage 606 to flow through the straw 502. The drainage rings 310-1 and 310-3 may be made of a membrane shape that provides the required flexibility to accomplish the desired air flow and allow the straw 502 to tilt in any way.

Once the primary air-lock is removed, the user may draw the straw air from the second end of the straw 502 to slightly release the grip of the drainage rings 310 on the straw 502 and assist in movement of air within the straw 502. Such drawing of air removes a positive air pressure within the straw 502 wherein this positive air pressure pushes the beverage 606 to stay within the bottle 604. Further drawing of the straw air creates a negative air pressure on the beverage 606, such that the negative air pressure pumps the beverage 606 out from the second end of the straw 502. When an external force applied on the straw 502 is removed, the drainage rings 310 push the straw 502 back to orient it perpendicular to the internal rings 306 and seal the air channels 312. In some embodiments, either the primary air-lock due to air-lock in the air channels 312 or the secondary air-lock due to the straw air, or both, may be removed in any order to assist the release of the beverage 606 from the second end of the straw 502. For example, the beverage may flow out from the orifice 112 by applying a negative pressure on the second end of the straw 502 or by squeezing the bottle 604 to increase the beverage pressure within the bottle 604, even when the primary air-lock in the air channels 312 is not removed.

The user may further manipulate the beverage outflow by applying additional pressure on the beverage 606 via the beverage bottle 604. For example, the beverage bottle 604 may be made of plastic or any other flexible material that may be pressed or squeezed to substantially increase the pressure applied on the beverage 606 for releasing the beverage 606 at an increased pressure from the second end of the straw 502. In essence, the beverage outflow may be controlled by the negative air pressure applied at the second end of the straw 502 and the pressure applied on the beverage 606 via the beverage bottle 604.

Once the beverage 606 is consumed, or if otherwise intended, the cap 100 may be removed from the bottle opening by pulling out or by pushing at least one of the first section 102 and the second section 104 outwards or sideways. The removed cap 100 may be rinsed or washed and re-used with another bottle 604 for controlling the beverage outflow. However, other embodiments are directed to disposable bottle caps, such as the bottle cap 100.

Figure 8A:
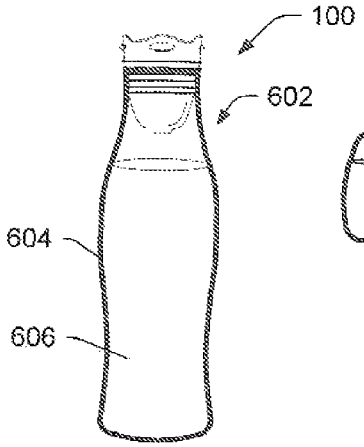
Figure 8B:
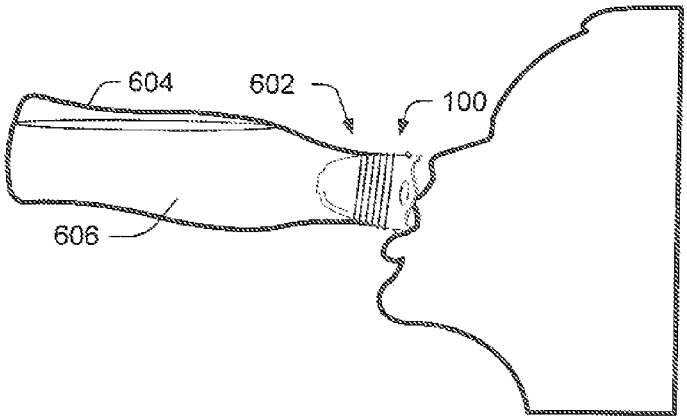

FIGS. 8A-8B illustrate a third exemplary scenario for using the cap 100 of FIG. 1. As shown in FIG. 8A, when the bottle opening is greater than the maximum diameter of the internal rings 306, but lesser than the maximum diameter of the external rings 116, the cap 100 may be inverted to insert the first section 102 into the bottle opening for controlling the beverage outflow. The inserted cap 100 may be secured on the bottle opening due to frictional engagement between the external rings 116 of the cap 100 and an inner surface of the bottle opening. The cap 100 may be gently pushed into the bottle opening until the cap 100 is tightly secured in an air-tight manner to prevent the beverage spillage. The cap 100 may be pressed such that at least one of the external rings 116 is coaxial with the bottle opening and seals the bottle opening. In some embodiments, a narrow portion 602 of the bottle 604 adjacent to the bottle opening may optionally include one or more inner rings (not shown) that may frictionally engage with the external rings 116 of the cap 100, such that the external rings 116 click down on top of the bottle's inner rings. The changing diameters of each of the external rings 116 may conform to the changing diameters of the bottle opening or that of the narrow portion 602 of the bottle 604. Additionally, the inverted cap 100 may be secured on the bottle opening in communication with the outward bend created in a predetermined portion, such as the bottom portion, of second section 104 in the folded configuration, as discussed above.

Other embodiments are intended to include the cap 100 in a reversed configuration for securing the cap 100 into the bottle opening, when the cap 100 is inverted. In the reversed configuration, the cap 100 may be manipulated so that the interior portion of the cap 100 including the internal rings 306, the drainage rings 310, and the air channels 312 are exposed to the external environment. In fact, embodiments are intended to use the internal rings 306 externally for securing the reversed cap 100 into the bottle opening in an air tight manner, when the reversed cap 100 is inverted. Such embodiment may thus eliminate the need of external rings 116.

As shown in FIG. 8B, a user may intend to drink the beverage 606 directly from the bottle 604 on which the cap 100 is inverted and disposed within a relatively large-sized bottle opening. The inverted cap 100 may behave like a cup, such that the bottom edge 114 of the cap 100 may be received into the person's mouth to hygienically consume the beverage 606. The bottle 604 may be held in a tilted orientation to slide the beverage 606 toward the orifice 112 of the cap 100 via the bottle opening. The orifice 112, which is relatively small in size, creates an air-lock to control the outward flow of beverage. Reducing the size of the orifice 112 thereby reduces the outward flow of beverage from the orifice 112 when the cap 100 is inverted.

The bottle cap 100 is intended to be used with bottles made of a variety of known, related art or later developed materials that are relatively flexible. For example, the bottle 604 may be made of plastic or any other suitable flexible material that may be pressed or squeezed to variably apply pressure on the beverage 606. Once the applied pressure increases beyond the air-lock pressure created by the orifice 112, the beverage 606 flows outward from the orifice 112. Ceasing further squeezing of the bottle 604 reduces the pressure applied on the beverage 606 below the air-lock pressure created by the orifice 112 to impede or prevent the release of the beverage 606 from the orifice 112 of the cap 100. This controlled release of the beverage 606 due to the air-lock created by the orifice 112 and the applied pressure on the beverage 606 impedes or prevents spilling or leaking of the beverage 606 if the bottle 604 is jerked, dropped, inverted, etc.

Once the beverage 606 is consumed, or if otherwise intended, the cap 100 may be pulled out from the bottle 604 by clinching the grips 120 or the bottom edge 114 of the cap 100 for removing the cap 100 from within the bottle opening. The removed cap 100 may be rinsed or washed and re-used with another bottle 604 for controlling the beverage outflow. However, other embodiments are directed to disposable bottle caps, such as the bottle cap 100.

Figure 9A:
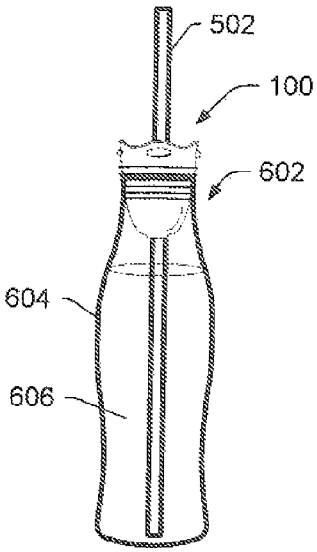

As shown in FIG. 9A, the cap 100 may be inverted and secured into a relatively large-sized bottle opening in an air-tight manner using at least one of the external rings 116, the second section 104 in the folded configuration, and the cap 100 in the reversed configuration, as described in the description of FIG. 8A. Once the cap 100 is secured, an elongated tube, such as a straw 502, may be received by the orifice 112 via the drainage rings 310 and the air channels 312, both of which are exposed to the external environment. The first end of the straw 502 may be submerged into the beverage 606 in the bottle 604 and a second end may extend out through the orifice 112. When used with a straw 502, the cap 100 is intended to be used with bottles made of a variety of known, related art or later developed materials. For example, the bottle 604 may be made of plastic, glass, silicone, aluminum or any other suitable food-grade material.

Although the air channels 312 of the cap 100 are in communication with the external environment, the straw 502 may be secured perpendicular to the internal rings 306 using the drainage rings 310 to create an air-lock within the straw 502 and impede or prevent the beverage outflow from the second end of the straw 502. The straw air exerts a uniform or substantially uniform pressure on the beverage 606 along the inner walls of the straw 502 based on Equation 1 discussed above to secure the beverage 606 inside the bottle 604 without spilling even when the bottle 604 is jerked, dropped or inverted, etc. Additionally, the dome-shape of the air channel 312-3 reduces the beverage pressure away from the drainage ring 310-3 when the bottle 604 is titled or inverted to impede the beverage outflow towards the orifice 112. The air channel 312-3 also tightens contact between the drainage ring 310-3 and the straw 502 due to the beverage pressure created when the bottle 604 is tilted or inverted.

Figure 9B:
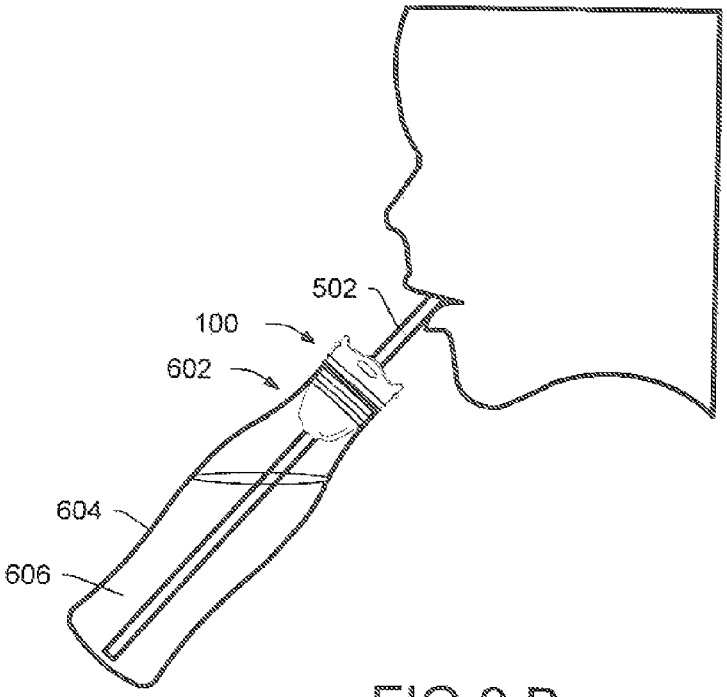

As shown in FIG. 9B, a user may consume the beverage 606 by receiving the second end of the straw 502 into the user's mouth. In order to release the beverage 606 so that it can flow out from the second end of the straw 502, the user may draw the straw air from the second end of the straw 502 to remove the positive air pressure on the beverage 606. The suction of the straw air slightly releases the grip of the drainage ring 310-3 on the straw 502 to let the air flow out from the second end of the straw 502. As the straw air is further drawn from the second end of the straw 502, a negative air pressure is created on the beverage 606 that pumps the beverage 606 out from the second end of the straw 502. The negative air pressure may be increased by tilting the straw 502 at any angle other than 90 degrees with respect to the internal rings 306 of the cap 100.

The user may further manipulate the beverage outflow by applying additional pressure on the beverage 606 via the beverage bottle 604. For example, the beverage bottle 604 may be made of plastic or any other flexible material that may be pressed or squeezed to substantially raise the pressure applied to the beverage 606 for releasing the beverage 606 from the second end of the straw 502 at an increased pressure. In essence, the beverage outflow may be controlled by the suction applied at the second end of the straw 502 and the pressure applied on the beverage 606 via the beverage bottle 604.

Once the beverage 606 is consumed, or if otherwise intended, the cap 100 may be pulled out by clinching the grips 120 located on the second section 104 of the cap 100 for removing the cap 100 from the bottle opening. The removed cap 100 may be rinsed or washed and re-used with another bottle 604 for controlling the beverage outflow. However, other embodiments are directed to disposable bottle caps, such as the bottle cap 100.

FIGS. 10-17B show a cap 200 according to a second embodiment. Components of the second embodiment that are similar or correspond to those in FIGS. 1-9B are given the same numbers as mentioned with regard to the cap 100. These components include the first section 102, the second section 104, the circular head 106, the orifice 112, the external rings 116 having the predetermined spacing 118, the internal rings 306 having the predetermined spacing 308, the exterior portion 302, the interior portion 304, the drainage rings 310, and the air channels 312. These components individually operate in a manner that is substantially the same for the corresponding components of the cap 100 of FIGS. 1-9B, and thus the structure and operation of these components is not repeated with regard to FIGS. 11A-17B.

Figure 10:
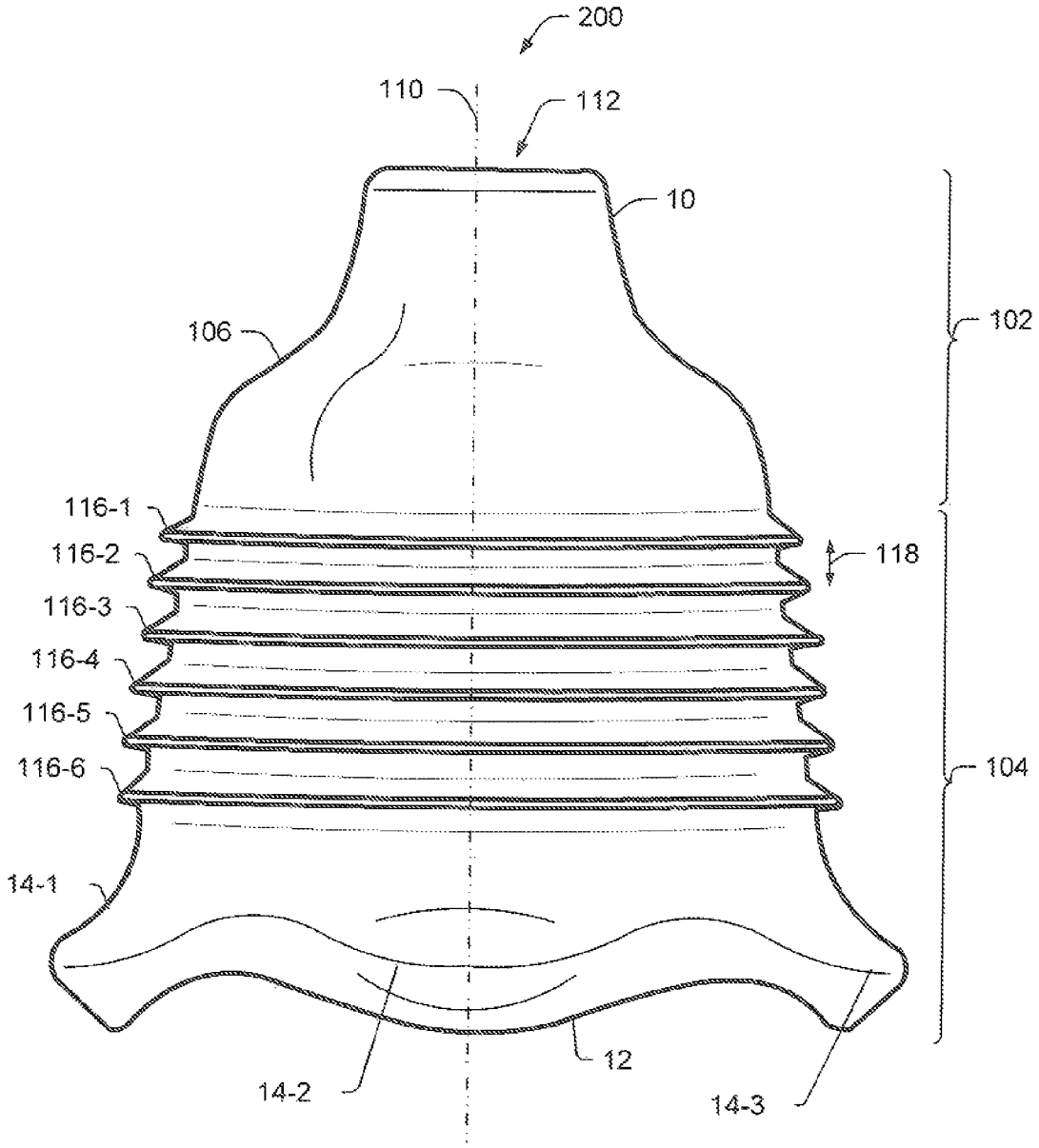
FIG. 10 is a schematic of a cap for controlling beverage outflow from a bottle, according to a second exemplary embodiment of the present disclosure.
Figure 1:
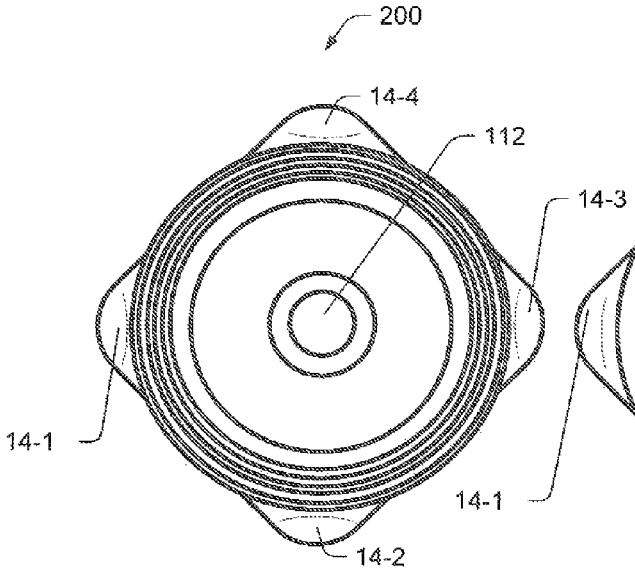
Figure 1:
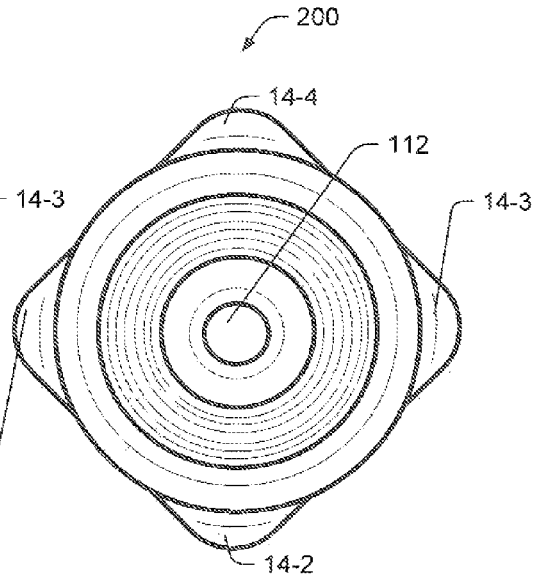
Figure 1:
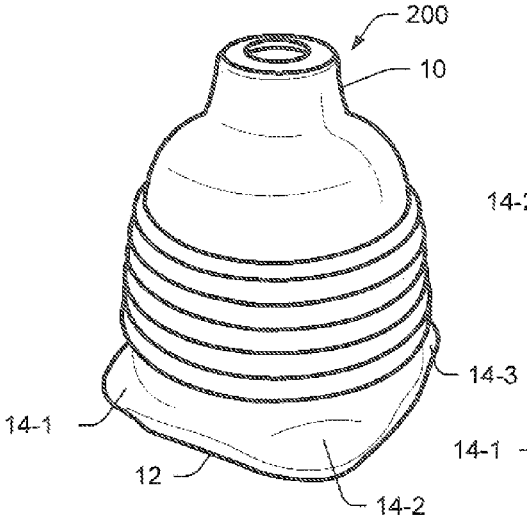
Figure 1:
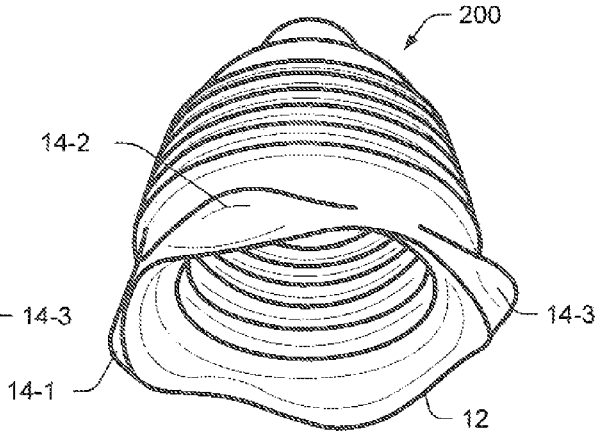
Figure 1:
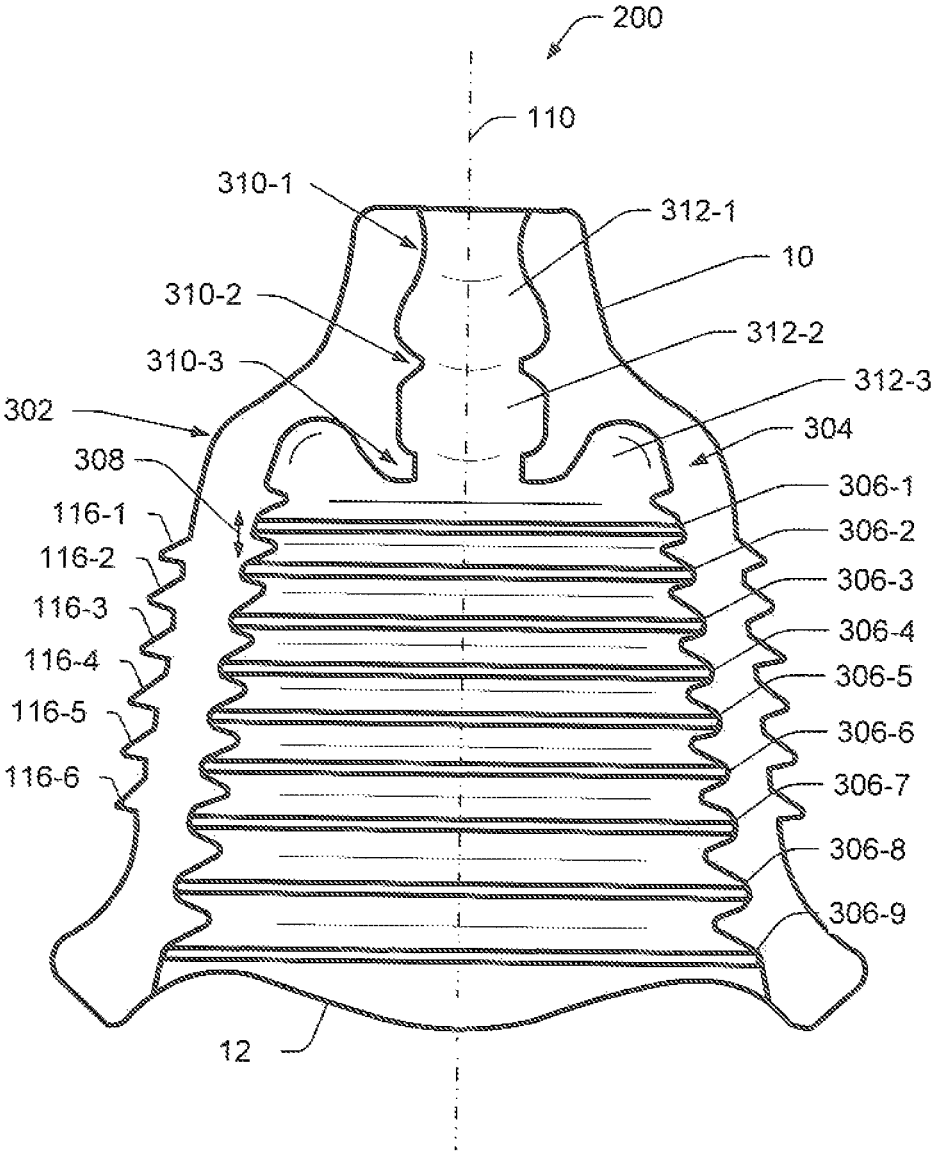
Figure 13:
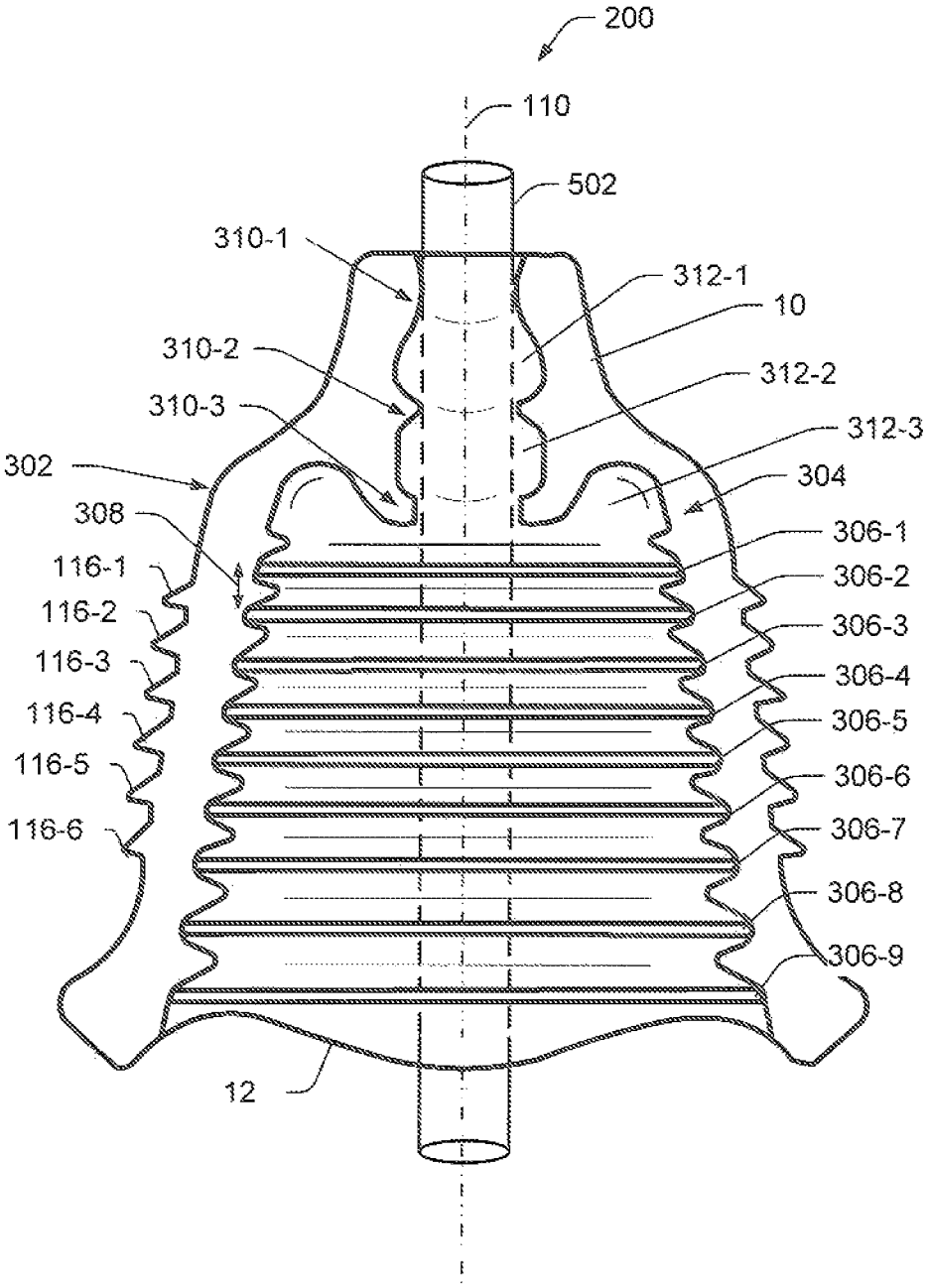
FIG. 13 is a schematic showing interior and exterior portions of the cap of FIG. 10 including a straw, according to an embodiment of a present disclosure.
Figure 1:
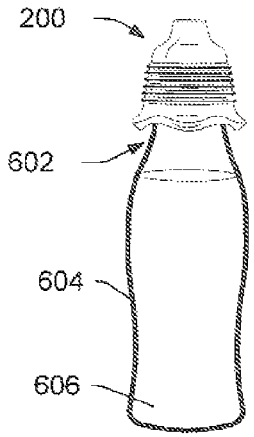
Figure 1:
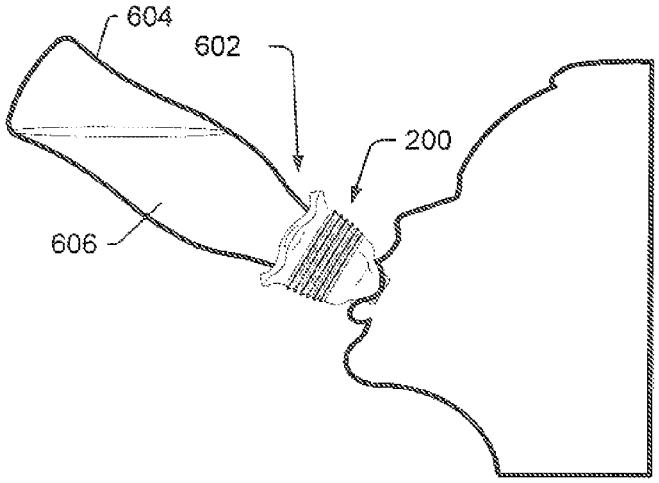

As shown in FIG. 10, the first section 102 of the cap 200 includes an elongate cylindrical projection 10 that has an extended length that may be relatively greater than that of the cylindrical projection 108 of cap 100. This extended length of the cylindrical projection 10 may be sufficiently received within a relatively smaller mouth of a person, such as the mouth of a child. In other words, the cylindrical projection is elongated and shaped for communication with a relatively small-sized mouth. The cylindrical projection 10 includes the orifice 112 and assists in longitudinally receiving an elongate tube, such as a straw. Similarly to the cylindrical projection 108, the cylindrical projection 10 guides a fluid, such as a beverage, that flows out through the orifice 112.

The second portion includes a bottom edge 12 that includes a greater amount of flare than the bottom edge 114 in the cap 100. This increased amount of flare of the bottom edge 12 enhances association or communication with an extraneous surface, such as the outer surface of a bottle. When the cap 200 is inverted and inserted into a bottle opening for securing the cap 200 to the bottle, the flared bottom edge 12 may be adapted to conform with contours of lips of an intended user and may be sufficiently received within the mouth of the intended user to guide a fluid, such as a beverage, flowing out from the orifice 112 of the cap 200 into the mouth. The flared bottom edge 12 may also be used to remove the cap 200 when it is inverted and is in communication with an extraneous surface, such as an outer surface of the bottle.

Similar to the cap 100, the second section 104 of the cap 200 may include a predetermined portion capable of being folded outward when manipulated. For example, the predetermined portion may be a bottom portion of the second section 104 including the bottom edge 12 that may be manipulated to a folded configuration. In the folded configuration, the bottom edge 12 may be folded radially outward until the bottom portion is folded inside-out such that the inner surface of the bottom portion is exposed to the external environment. The folded bottom portion includes an outward bend about which the bottom portion extends upward towards the first section 102.

Once the predetermined portion is folded substantially outward, it may be maintained in the folded configuration using a variety of techniques. In one example, an inner surface of the predetermined portion may include one or more physical structures that facilitate to maintain the predetermined portion in the folded configuration. Examples of these physical structures include, but not limited to, grooves, indentations, projections, and so on. In another example, the predetermined portion may have a suitable folded length that maintains the predetermined portion in the folded configuration. The folded length is sufficiently long that resists a retracting force induced in an outward bend created in the predetermined portion. In some embodiments, the outward bend may secure an extraneous surface, such as a narrow edge of a bottle opening, between an outer surface of the predetermined portion and the outer surface of the second section 104, when the cap 200 is inverted. The folded predetermined portion may be manipulated to straighten it about the outward bend until the cap 200 regains its original conical shape, such as when the cap 200 is to be removed from the bottle opening.

The second section 104 may further include one or more grips 14-1, 14-2, and 14-3 (collectively, grips 14) between the bottom-most external ring, such as the external ring 116-6, and the bottom edge 12 of the second section 104. Similar to the grips 120 of cap 100, each of the grips 14 may be located in a quadrant associated with a circular cross-section between the bottom-most external ring 116-6 and the bottom edge of the second section 104. The grips 14 may be placed relatively adjacent to the bottom edge 12, although they may be placed at any other suitable location on the second section 104. The grips 14 strengthen the bottom edge 12 and further facilitate removal of the cap 200 from the extraneous surface when the cap 200 is inverted and is in communication with the extraneous surface.

As shown in FIGS. 11A-13, the cap 200 includes the internal rings 306 and the drainage system having the drainage rings 310 and the air channels 312 that operate with and without the straw 502 as described above to impede or prevent unintended outflow of beverage from a bottle.

Further, the description of FIGS. 6A-9B relate to the implementation of the cap 100 in different scenarios. However other embodiments of the cap, such as the cap 200, may be similarly implemented using the elongate cylindrical projection 10, the flared bottom edge 12, and the grips 14 as shown in FIGS. 14A-17B.

As shown in FIG. 14A, the cap 200 may be disposed over an opening of the bottle 604 housing the beverage 606. The cap 200 may be gently pushed down on to or screwed to the bottle opening by holding the first section 102 from the top or sideways. The cap 200 may be manipulated until it secures the bottle opening in an air-tight manner using the internal rings 306 that frictionally engage with the bottle opening or the narrow portion 602 of the bottle 604, or both. The increased amount of flare of the bottom edge 12 enhances association or communication of the cap 200 with the narrow portion 602 of the bottle 604. The diameters of each of the internal rings 306 conform to the same or changing diameters of the narrow portion 602 of the bottle 604, such that the diameter of the upper-most internal ring, such as the internal ring 306-1 may be substantially equivalent to the diameter of the bottle opening.

The orifice 112 of the cap 200 is in fluid communication with the bottle opening via the drainage system including the drainage rings 310 and the air channels 312. The air in the air channels 312 creates an air-lock that in combination with an appropriate size of the orifice 112 impedes or prevents the beverage 606 to flow out from the orifice 112. Moreover, the dome-shape of the air channel 312-3 spreads and reduces the beverage pressure away from the drainage ring 310-3 to impede the beverage flow to the orifice 112, thereby securing the beverage 606 inside the bottle 604 without spilling even when the bottle 604 is jerked, dropped or inverted.

As shown in FIG. 14B, a person may intend to drink the beverage 606 directly from the bottle 604 on which the cap 200 is disposed. The cylindrical projection 10 from the first section 102 of the cap 200 may be received into the person's mouth to hygienically consume the beverage 606. The cylindrical projection 10 is relatively elongated so that it is comfortably and sufficiently received even into a relatively smaller mouth of a person such as the mouth of a child. Whilst the projection 10 is appropriately received within the mouth, the bottle 604 may be tilted to slide the beverage 606 toward the orifice 112 of the cap 200 via the bottle opening.

The cap 200 may be disposed over the bottle opening of bottles made of various known, related art or later developed materials that are relatively flexible. For example, the bottle 604 may be made of plastic that may be pressed or squeezed to increase the beverage pressure beyond the air-lock-pressure within the bottle 604. The increased beverage pressure may push out the air in the air channels 312 to release the beverage 606 from the orifice 112. Further squeezing of the bottle 604, increases the pressure of beverage flowing out from the orifice 112. Once the applied pressure on the bottle 604 is removed, the beverage pressure goes below the air-lock pressure created by the air channels 312 and the orifice 112 of suitable sizes, thereby impeding or preventing the release of the beverage 606 from the orifice 112 of the cap 200. Such a controlled release of the beverage 606 due to the air-lock created by the air channels 312 and the orifice 112, as well as the applied pressure on the beverage 606 impedes or prevents spilling or leaking of the beverage 606 if the bottle 604 is jerked, dropped, inverted, etc.

Once the beverage 606 is consumed, or if otherwise intended, the cap 200 may be removed from the bottle opening by pulling out or by pushing at least one of the first section 102 and the second section 104 outwards or sideways. The removed cap 200 may be rinsed or washed and re-used with another bottle 604 for controlling the beverage outflow. However, other embodiments are directed to disposable bottle caps, such as the bottle cap 200.

Figure 15A:
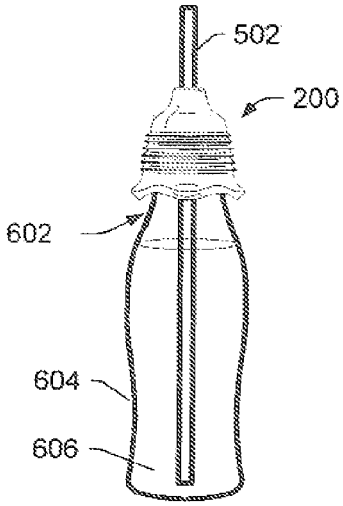
Figure 1:
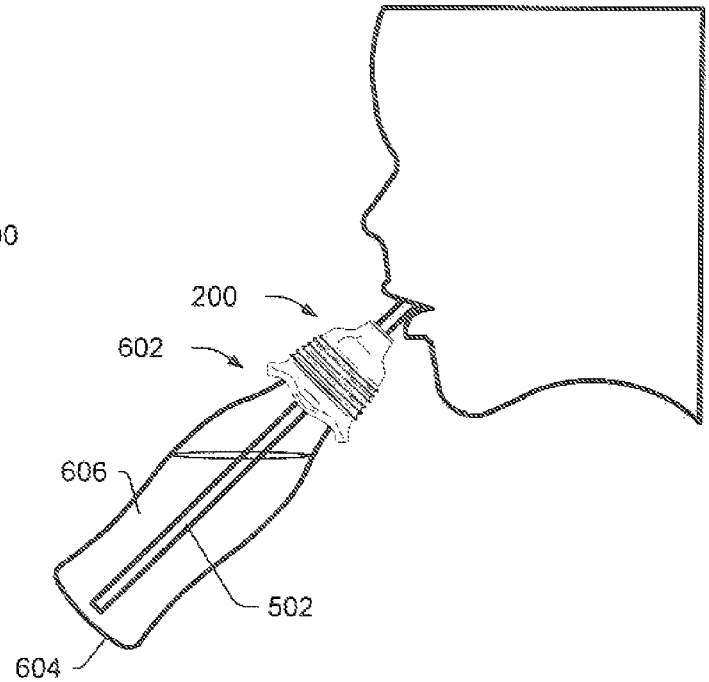
Figure 1:
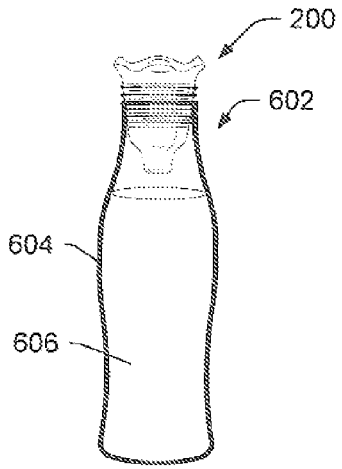
Figure 1:
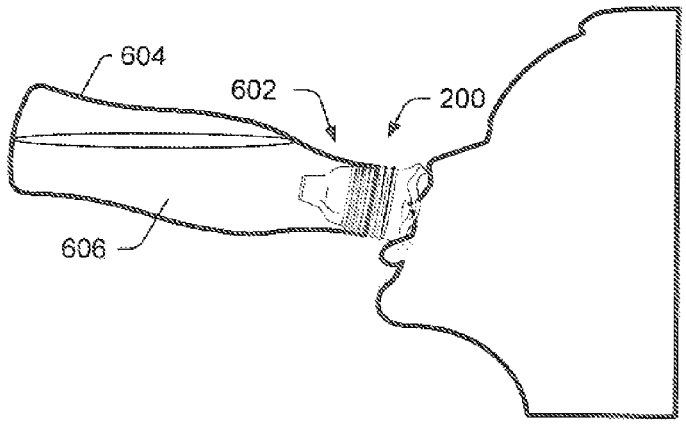
Figure 1:
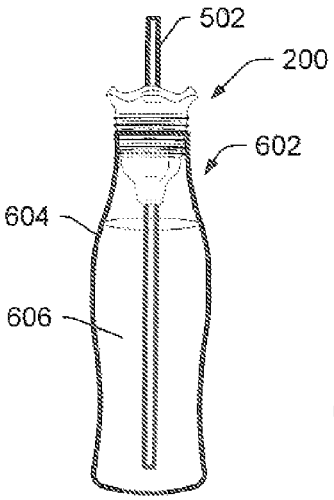

FIGS. 15A-15B illustrate a second scenario for using the exemplary cap 200 of FIG. 10. As shown in FIG. 15A, the cap 200 may be secured over the bottle opening in an air-tight manner using the internal rings 306, thereby creating an air-lock that secures the beverage 606 within the bottle. The orifice 112 is in fluid communication with the bottle opening via the air channels 312 as described in the description of FIG. 14A. In some embodiments, an elongated tube, such as the straw 502, may be received by the orifice 112 and extended into the bottle 604 via the drainage rings 310 and the air channels 312 in the cap 200. The straw 502 may have a first end submerged into the beverage 606 in the bottle 604 and a second end extending out through the orifice 112. When used with a straw 502, the cap 200 is intended to be used with bottles made of a variety of known, related art or later developed materials. For example, the bottle 604 may be made of plastic, glass, silicone, aluminum or any other suitable food-grade material.

The straw 502 is secured within the cap 200 using the drainage rings 310 and seals the air channels 312 when held perpendicular to the internal rings 306. The trapped air in the sealed air channels 312 creates a primary air-lock that impedes or prevents the beverage 606 to outflow or leak along the outer surface of the straw 502. Additionally, the straw 502 has a predetermined diameter and height that creates a suitable air-lock within the straw 502 according to Equation 1 discussed above. This secondary air-lock due to the straw air along with the primary air-lock due to sealed air channels 312 impedes or prevents any unintended release of the beverage 606 from the orifice 112 through the bottle opening. Therefore, the cap 200 with the straw 502 secures the beverage 606 within the bottle 604 without spilling even if the bottle 604 is jerked, dropped, or inverted, etc.

As shown in FIG. 15B, a user may consume the beverage 606 by receiving the second end of the straw 502 into the user's mouth. In order to release the beverage 606 from the second end of the straw 502, the user may draw the straw air from the second end of the straw 502 to slightly release the hold of the drainage rings 310 on the straw 502 and assist in movement of air within the straw 502. Such drawing of air removes a positive air pressure within the straw 502, wherein the positive air pressure that pushes the beverage 606 to stay within the bottle 604. Further drawing of the straw air creates a negative air pressure on the beverage 606, such that the negative air pressure pumps the beverage 606 out from the second end of the straw 502.

Additionally, the primary air-lock may be removed by angling the straw 502 using the flexibility of the drainage rings 310 and the air channels 312. The straw 502 may be forced to tilt at any suitable angle, except 90 degrees with respect to the internal rings 306. The angled straw 502 opens-up the air channels 312 to release the trapped air, and in turn eases the pressure on the beverage 606 for assisting the beverage 606 to flow through the straw 502. The drainage rings 310-1 and 310-3 may be made of a membrane shape that provides the required flexibility to accomplish the desired air flow and allow the straw 502 to tilt in any way.

When a tilting external force applied on the straw 502 is removed, the drainage rings 310 push the straw 502 back to orient it perpendicular to the internal rings 306 and seal the air channels 312. In some embodiments, either the primary air-lock due to air-lock in the air channels 312 or the secondary air-lock due to the straw air, or both, may be removed in any order to assist the release of the beverage 606 from the second end of the straw 502. For example, the beverage may flow out from the orifice 112 by applying a negative pressure on the second end of the straw 502 or by squeezing the bottle 604 to increase the beverage pressure within the bottle 604, even when the primary air-lock in the air channels 312 is not removed.

The user may further manipulate the beverage outflow by applying additional pressure on the beverage 606 via the beverage bottle 604. For example, the beverage bottle 604 may be made of plastic that may be pressed or squeezed to substantially increase the pressure applied on the beverage 606 for releasing the beverage 606 at an increased pressure from the second end of the straw 502. In essence, the beverage outflow may be controlled by the negative air pressure applied at the second end of the straw 502 and the pressure applied on the beverage 606 via the beverage bottle 604.

Once the beverage 606 is consumed, or if otherwise intended, the cap 200 may be removed from the bottle opening by pulling out or by pushing at least one of the first section 102 and the second section 104 outwards or sideways. The removed cap 200 may be rinsed or washed and re-used with another bottle 604 for controlling the beverage outflow. However, other embodiments are directed to disposable bottle caps, such as the bottle cap 200.

FIGS. 16A-16B illustrate a third exemplary scenario for using the cap 200 of FIG. 10. As shown in FIG. 16A, when the bottle opening is greater than the maximum diameter of the internal rings 306, but lesser than the maximum diameter of the external rings 116, the cap 200 may be inverted to insert the first section 102 into the bottle opening for controlling the beverage outflow. The inserted cap 200 may be secured into the bottle opening in an air-tight manner using the external rings 116 of the cap 200 to prevent the beverage spillage. The cap 200 may be pressed such that at least one of the external rings 116 is coaxial with the bottle opening and seals the bottle opening. In some embodiments, the narrow portion 602 of the bottle 604 adjacent to the bottle opening may optionally include one or more inner rings (not shown) that may frictionally engage with the external rings 116 of the cap 200, such that the external rings 116 click down on top of the bottle's inner rings. The changing diameters of each of the external rings 116 may conform to the changing diameters of the bottle opening or that of the narrow portion 602 of the bottle 604. Additionally, the inverted cap 200 may be secured on the bottle opening within the outward bend created in a predetermined portion, such as the bottom portion, of second section 104 in the folded configuration, as discussed above.

Other embodiments are intended to include the cap 200 in a reversed configuration for securing the cap 200 into the bottle opening, when the cap 200 is inverted. In the reversed configuration, the cap 200 may be manipulated so that the interior portion of the cap 200 including the internal rings 306, the drainage rings 310, and the air channels 312 are exposed to the external environment. In fact, embodiments are intended to use the internal rings 306 externally for securing the reversed cap 200 into the bottle opening in an air tight manner, when the reversed cap 200 is inverted. Such embodiment may thus eliminate the need of external rings 116.

As shown in FIG. 16B, a user may intend to drink the beverage 606 directly from the bottle 604 on which the cap 200 is inverted and disposed within a relatively large-sized bottle opening. The inverted cap 200 may behave like a cup to hygienically consume the beverage 606. In some embodiments, the flared bottom edge 12 of the cap 200 may be sufficiently received into the person's mouth such that the drinking experience is enhanced. Whilst the flared bottom edge 12 is in communication with lips and into the mouth, the bottle 604 may be tilted to slide the beverage 606 toward the orifice 112 of the cap 200 via the bottle opening. The orifice 112, which is relatively small in size, creates an air-lock to control the outward flow of beverage 606. Reducing the size of the orifice 112 thereby reduces the outward flow of beverage from the orifice 112 when the cap 200 is inverted.

The bottle cap 200 is intended to be used with bottles made of a variety of known, related art or later developed materials that are relatively flexible. For example, the bottle 604 may be made of plastic that may be pressed or squeezed to increase the beverage pressure within the bottle 604 beyond the air-lock pressure created by the orifice 112. Further squeezing of the bottle 604 releases the beverage 606 outward from the orifice 112. When such squeezing of the bottle 604 is ceased, the beverage pressure reduces below the air-lock pressure to impede or prevent the release of the beverage 606 from the orifice 112 of the cap 200. This controlled release of the beverage 606 due to the air-lock created by the orifice 112 and the applied pressure on the beverage 606 impedes or prevents spilling or leaking of the beverage 606 if the bottle 604 is jerked, dropped, inverted, etc.

Once the beverage 606 is consumed, or if otherwise intended, the cap 200 may be pulled out from the bottle 604 by clinching the grips 14 or the flared bottom edge 12 of the cap 200 for removing the cap 200 from within the bottle opening. The removed cap 200 may be rinsed or washed and re-used with another bottle for controlling the beverage outflow. However, other embodiments are directed to disposable bottle caps, such as the bottle cap 200.

Further as shown in FIG. 17A, the cap 200 may be inverted and secured into a relatively large-sized bottle opening in an air-tight manner using at least one of the external rings 116, the second section 104 in the folded configuration, and the cap 100 in the reversed configuration, as described in the description of FIG. 16A. Once the cap 200 is secured, an elongated tube, such as a straw 502, may be received by the orifice 112 via the drainage system including the drainage rings 310 and the air channels 312, both of which are exposed to the external environment. The first end of the straw 502 may be submerged into the beverage 606 in the bottle 604 and a second end may extend out through the orifice 112.

Although the air channels 312 of the cap 200 are in communication with the external environment, the straw 502 may be secured perpendicular to the internal rings 306 using the drainage rings 310 to create an air-lock within the straw 502 and impede or prevent the beverage outflow from the second end of the straw 502. The straw air exerts a uniform or substantially uniform pressure on the beverage 606 along the inner walls of the straw 502 based on Equation 1 discussed above to secure the beverage 606 inside the bottle 604 without spilling even when the bottle 604 is jerked, dropped or inverted, etc. Additionally, the dome-shape of the air channel 312-3 reduces the beverage pressure away from the drainage ring 310-3 when the bottle 604 is titled or inverted to impede the beverage outflow towards the orifice 112. The air channel 312-3 also tightens contact between the drainage ring 310-3 and the straw 502 due to the beverage pressure created when the bottle 604 is tilted or inverted.

Figure 17B:
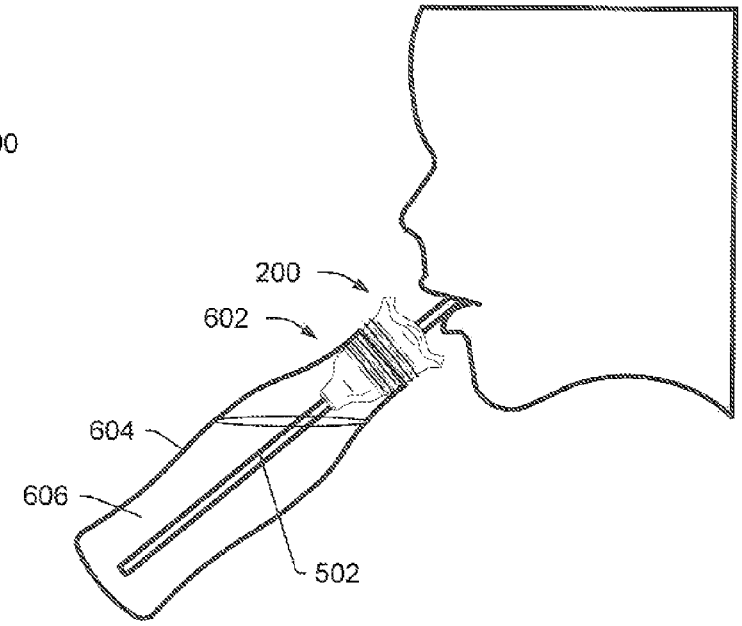

As shown in FIG. 17B, a user may consume the beverage 606 by receiving the second end of the straw 502 into the user's mouth. In order to release the beverage 606 so that it can flow out from the second end of the straw 502, the user may draw the straw air from the second end of the straw 502 to remove the positive air pressure on the beverage 606. The suction of the straw air slightly releases the grip of the drainage ring 310-3 on the straw 502 to let the air flow out from the second end of the straw 502. As the straw air is further drawn from the second end of the straw 502, a negative air pressure is created on the beverage 606 that pumps the beverage 606 out from the second end of the straw 502. The negative air pressure may be increased by tilting the straw 502 at any angle other than 90 degrees with respect to the internal rings 306 of the cap 200.

The user may further manipulate the beverage outflow by applying additional pressure on the beverage 606 via the beverage bottle 604. For example, the beverage bottle 604 may be made of plastic or any other flexible material that may be pressed or squeezed to substantially raise the pressure applied to the beverage 606 for releasing the beverage 606 from the second end of the straw 502 at an increased pressure. In essence, the beverage outflow may be controlled by the suction applied at the second end of the straw 502 and the pressure applied on the beverage 606 via the beverage bottle 604.

Once the beverage 606 is consumed, or if otherwise intended, the cap 200 may be pulled out by clinching the grips 14 located on the second section 104 of the cap 200 for removing the cap 200 or the flared bottom edge 12 from the bottle opening. The removed cap 200 may be rinsed or washed and re-used with another bottle 604 for controlling the beverage outflow. However, other embodiments are directed to disposable bottle caps, such as the bottle cap 200.

The caps 100, 200 are relatively small in size and suitable for standard beverage bottles, since the caps 100, 200 may be inverted to fit bottle openings of different sizes. The caps 100, 200 significantly reduce, impede or prevent unintended beverage outflow from a beverage bottle to reduce or avoid beverage spillage or leakage. Moreover, the caps 100, 200 provide a spill-proof solution when a straw is inserted into the caps 100, 200 to reduce, impede, or prevent the beverage spillage due to the drainage system described above, despite the bottle being jerked, inverted, squeezed or dropped.

Although the caps 100, 200 has been explained with respect to the bottle 604, it will be well understood by a person skilled in the art that the operating principle of the caps 100, 200 can be incorporated or otherwise used with other containers having a narrow or other opening for dispensing a fluid such as an beverage, liquid chemicals, air, and so on. The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the subject matter as encompassed by the following claims.

What is claimed is:

1. A cap for controlling fluid flow from a bottle that includes a first opening having a first diameter for dispensing the fluid, the cap being configured for use with a tube, the cap comprising:

a first plurality of rings, at least one of the first plurality of rings being formed on an inner surface second section of the cap having a first diameter to be secured over the first opening of the bottle;

drainage rings formed on an inner surface first section of the cap that surround one or more air channels, an orifice being defined to be in flow communication with the one or more air channels that are surrounded by the draining rings, wherein the orifice is configured to receive the tube, such that the tube can be secured by the one or more draining rings for sealing the one or more air channels, and such that the tube is oriented perpendicular to the at least one of the first plurality of rings, wherein at least one portion of the cap is folded inside-out about an outward bend upon manipulation, wherein the outward bend is adapted to secure a second opening of the bottle when the cap is inverted, wherein the second opening has a diameter greater than the first diameter and relatively less than a maximum diameter of the cap.

2. The cap of claim 1, wherein the cap is reversed upon manipulation such that at least one of the first plurality of rings and the one or more drainage rings is exposed to the external environment.

3. The cap of claim 1, further comprising contours configured to facilitate placement and removal of the cap over the bottle.

4. The cap of claim 1, further comprising at least one protruding member adapted to assist removal of the cap from the bottle.

5. The cap of claim 1, wherein the cap is flexible.

6. The cap of claim 1, wherein the bottle is manipulated to control the fluid flow through the orifice, wherein the bottle is configured such that squeezing the bottle increases the fluid flow through the orifice.

7. The cap of claim 1, wherein a plurality of the drainage rings secured within the first opening when the cap is inverted.

8. The cap of claim 1, wherein a predetermined spacing is maintained between each pair of rings of the first plurality of rings.

9. The cap of claim 1, wherein the one or more drainage rings can be configured to communicate with the tube to create an air-lock to impede the unintended fluid flow from the cap.

10. The cap of claim 1, wherein an air lock that applies a pressure greater than a fluid pressure within the bottle for securing the fluid within the bottle when the tube has a predetermined diameter and a predetermined height, at least one of which creates an air-lock within the tube.

11. The cap of claim 7, wherein a predetermined spacing is maintained between each drainage ring.

12. A cap for controlling fluid flow from a bottle that includes a first opening having a first diameter for dispensing the fluid, the cap comprising:

a first section defining an orifice, configured to receive a tube, and at least one air channel, the first opening of the bottle being in flow communication with the orifice and the at least one air channel; and a second section including a first plurality of rings formed on an inner surface of the second section for securing the cap to the first opening of the bottle, wherein, when the tube is received in the orifice, the tube can seal at least one of the air channels to create an air-lock to secure the fluid within the bottle, wherein the second section includes a bottom edge having a curved contour and an inner surface having a predetermined slope to facilitate placement and removal of the cap over the bottle.

13. The cap of claim 12, wherein at least one portion of the second section can be folded inside out about an outward bend upon manipulation, wherein the outward bend is adapted to secure a second opening of the bottle when the cap is inverted, wherein the second opening has a diameter greater than a first diameter of the inner surface and less than a maximum diameter of the cap.

14. The cap of claim 13, wherein the first section and the second section are reversed upon manipulation such that the first plurality of rings externally secure the cap into at least one of the first opening and the second opening when the cap is inverted.

15. The cap of claim 13, wherein the second section includes at least one protruding member adapted to assist removal of the cap from the bottle provided the cap is inverted and inserted into at least one of the first opening and the second opening.

16. The cap of claim 12, wherein the cap is flexible.

17. The cap of claim 12, wherein the bottle is manipulated to control the fluid flow through the orifice, and the bottle is configured such that squeezing the bottle increases the fluid flow through the orifice.

18. The cap of claim 12, wherein the first section further includes one or more drainage rings disposed around the each of the one or more one or more air channels.

19. The cap of claim 18, wherein the tube has a predetermined diameter and a predetermined height, at least one of which creates an air-lock within the tube, such that the airlock applies a pressure greater than a fluid pressure within the bottle for securing the fluid within the bottle.

20. The cap of claim 12, wherein a predetermined spacing is maintained between each pair of rings of the first plurality of rings.

21. A system for controlling fluid flow from a bottle that includes a first opening having a first diameter for dispensing the fluid, the system comprising:

a cap including:

a first plurality of rings, at least one of the first plurality of rings being secured over the first opening of the bottle; and one or more drainage rings formed on an inner surface first section of the cap;

an orifice being defined to be in flow communication with one or more air channels that are surrounded by the one or more drainage rings; and a tube configured to be received by the orifice, and to be secured by the one or more drainage rings for sealing the one or more air channels, such that the tube can be oriented perpendicular to the at least one of the first plurality of rings, wherein the cap further includes an edge having a curved contour and an inner surface having a predetermined slope to facilitate placement and removal of the cap over the bottle.

22. The system of claim 21, wherein at least one portion of the cap can be folded inside out about an outward bend upon manipulation, wherein the outward bend is adapted to secure a second opening of the bottle when the cap is inverted, wherein the second opening has a diameter greater than a first diameter of the inner surface and less than a maximum diameter of the cap.

23. The system of claim 22, wherein, when the cap is inverted upon manipulation, the first plurality of rings are exposed as an external surface and upon insertion of the cap into the second opening, the first plurality of rings externally secures the cap into the second opening.

24. The system of claim 21, wherein the cap includes at least one protruding member adapted to assist removal of the cap from the bottle when the cap is inverted and inserted into the second opening.

25. The system of claim 21, wherein the cap is flexible.

26. The system of claim 21, wherein the bottle is configured such that squeezing the bottle increases the fluid flow through tube.

27. The system of claim 21, wherein the bottle is configured such that squeezing the bottle increases the fluid flow through the orifice when tube is removed.

28. The system of claim 21, wherein the tube is titled at an angle other than 90 degrees with respect to the at least one of the first plurality of rings to unseal at least one of the one or more air channels.

29. The system of claim 21, wherein a predetermined spacing is maintained between each pair of rings of the first plurality of rings.

30. The system of claim 21, wherein an air lock that applies a pressure greater than a fluid pressure within the bottle for securing the fluid within the bottle when the tube has a predetermined diameter and a predetermined height, at least one of which creates an air-lock within the tube.

* * * * *